US008502841B2

(12) United States Patent
Yui

(10) Patent No.: US 8,502,841 B2
(45) Date of Patent: Aug. 6, 2013

(54) IMAGE DISPLAY APPARATUS AND METHOD FOR CONTROLLING IMAGE DISPLAY APPARATUS

(75) Inventor: Hideaki Yui, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 362 days.

(21) Appl. No.: 13/025,575

(22) Filed: Feb. 11, 2011

(65) Prior Publication Data

US 2011/0199398 A1 Aug. 18, 2011

(30) Foreign Application Priority Data

Feb. 18, 2010 (JP) ..... 2010-033914

(51) Int. Cl.
*G09G 5/10* (2006.01)

(52) U.S. Cl.
USPC ..... 345/690; 345/88; 345/89

(58) Field of Classification Search
USPC ..... 345/55, 76, 89, 690–693, 88
See application file for complete search history.

(56) References Cited

U.S. PATENT DOCUMENTS 7,227,519 B1 6/2007 Kawase et al.
7,817,115 B2 10/2010 Yui
7,830,339 B2 11/2010 Yui
2006/0214940 A1* 9/2006 Kinoshita et al. ..... 345/589
2007/0252782 A1 11/2007 Yui
2008/0136846 A1* 6/2008 Abe et al. ..... 345/690

FOREIGN PATENT DOCUMENTS

JP 11-202827 A 7/1999
JP 2000-122598 A 4/2000
JP 2000-250463 A 9/2000
JP 2001-350442 A 12/2001
JP 2004-157309 A 6/2004

* cited by examiner

*Primary Examiner* — Koosha Sharifi-Tafreshi
(74) *Attorney, Agent, or Firm* — Fitzpatrick, Cella, Harper & Scinto

(57) ABSTRACT

An image display apparatus of the present invention includes: a display panel; a storage unit that stores a plurality of correction values which are used for correction processing for decreasing brightness variation; a correction unit; and a control unit, wherein the control unit divides the display panel into a plurality of sub-areas, calculates, for each sub-area, a select block gradation value, and executes, for each sub-area, a control to read correction values, which are used for calculating a correction value corresponding to the select block gradation value, out of the plurality of correction values, using the correction unit, and the correction unit calculates, for each sub-area, a correction value corresponding to the select block gradation value using the read correction values, and converts gradation values of video signals in the sub-area using the calculated correction value.

15 Claims, 20 Drawing Sheets

BLOCK GRADATION POINT SELECT SIGNAL
2003
THRESHOLD COMPARISON UNIT
THRESHOLD (u_th, m_th, l_th, l'_th)
SLECT BLOCK GRADATION VALUE
EDGE DETECTION SIGNAL
SELECTOR
2006
BRIGHT AREA BLOCK GRADATION VALUE
BLOCK GRADATION VALUE
BLOCK GRADATION VALUE CALCULATION UNIT
EDGE PATTERN DETECTION UNIT
2005
2004
2002
BLOCK BUFFER
D0
D1
D2
D3
2001
S3

FIG. 10

| IN BLOCK IMAGE PATTERN | BLOCK GRADATION VALUE |
|---|---|
| SOLID<br>64 64 64 64 | 64 |
| EDGE<br>0 0 128 128 | 64<br>BRAIGHT AREA<br>BLOCH GRADATION VALUE : 128<br>DARK AREA<br>BLOCH GRADATION VALUE : 0 |
| TOGGLE<br>128 0 128 0 | 64 |

COEFFICIENT PAIR SELECTION IN COLOR BLOCK UNIT

COEFFICIENT PAIR SELECTION IN PIXEL BLOCK UNIT

PHYISICAL ADDRESS PLANE IN COLOR BLOCK UNIT

ACCESS FORMAT IN COLOR BLOCK UNIT

PHYISICAL ADDRESS PLANE IN PIXEL BLOCK UNIT

ACCESS FORMAT IN PIXEL BLOCK UNIT

IMAGE DISPLAY APPARATUS AND METHOD FOR CONTROLLING IMAGE DISPLAY APPARATUS

BACKGROUND OF THE INVENTION

1. Field of the Invention

The present invention relates to an image display apparatus and a method for controlling the image display apparatus.

2. Description of the Related Art

Image display apparatuses such as liquid crystal display apparatuses (LCD), plasma display apparatuses (PDP), field emission display apparatuses (FED), and organic EL display apparatuses (OLED) are available as flat panel display apparatuses (FPD).

In these FPDs, a large number of display elements must be formed on a substrate. A light emission characteristic of the display elements is affected by slight differences in manufacturing conditions and so on. Therefore, it is typically difficult to make the light emission characteristics of all of the display elements provided in the FPD perfectly uniform. Unevenness in the light emission characteristic causes brightness variation, leading to deterioration of an image quality. In the case of an FED, for example, surface conduction type electron-emitting devices, Spindt type electron-emitting devices, MIM type electron-emitting devices, and carbon nanotube type electron-emitting devices are used as electron-emitting devices. When differences occur in a shape or the like of the electron-emitting devices due to differences in the manufacturing conditions of the electron-emitting devices and so on, variation occurs in an electron emission characteristic of the electron-emitting devices. As a result, brightness variation occurs, leading to deterioration of the image quality.

In response to this problem, a constitution for correcting a video signal in accordance with the light emission characteristic of each display element has been proposed (brightness variation correction). For example, in one method, correction data including an adjustment ratio (a correction value) for reducing brightness variation are prepared in advance for each display element and the brightness variation is reduced by multiplying the adjustment ratio by an input video signal. However, the brightness variation may be dependent on a gradation value (the variation may be gradation-dependent). Therefore in order to decrease brightness variation for all the gradation values, a correction value corresponding to each gradation value must be provided.

Furthermore in the above mentioned brightness variation correction, a correction value corresponding to a video signal (gradation value) for the element is selected for each element constituting the pixel and the correction is performed. Therefore the correction values of all the gradation values must be read in advance from a memory (storage unit) storing the correction values.

This means that the processing band (processing band of a memory) which is required when correction data is read from the necessary memory increases as the performance of the display panel, such as gradation performance and definition, improves. In concrete terms, in the case of improving the display performance in a low gradation area (area in which gradation value is small), the brightness variation increases as gradation decreases, so more correction values must be provided for gradation values used for a low gradation area. This increases the capacity (processing capacity) of the correction data to be transferred (correction data which must be read in advance), and also increases the required processing band of memory. In order to support an ultra high definition standard, such as 4K2K for supporting digital cameras, from 2K1K, which is the current HDTV broadcasting standard, a higher definition is required, and the required processing speed (speed to read the correction values) increases in proportion to the increase of definition. Since the required processing band of memory is determined by processing capacity×processing speed, higher definition increases the required processing band of memory.

Possible methods for supporting this increase in processing band are increasing functions or increasing speed of memory (volatile memory). However if functions of a volatile memory are increased, cost increase or other problems occur due to the drastic increase in the number of pins of the LSI for controlling the volatile memory. In terms of increasing speed of a volatile memory, increasing speed exceeding a predetermined level is not easy, because device performance of the volatile memory is limited, and the degree of difficulty in substrate design increases.

If the capacity of the correction data is decreased in order to decrease the required processing band of memory, correction performance drops. In other words, the effect of decreasing processing band of memory and the effect of correcting brightness variation are in a trade-off relationship.

Hence improving display performance by an inexpensive system dramatically increases the value of FPD.

Available prior art on brightness variation correction are, for example, technologies disclosed in Japanese Patent Application Laid-Open Nos. 2000-122598, 2001-350442 and H11-202827, but the above mentioned problem cannot be solved by these technologies.

Both of the technologies of Japanese Patent Application Laid-Open Nos. 2000-122598 and 2001-350442 are technologies for decreasing gradation-dependent brightness variation, and are not for decreasing the required processing band of memory. In concrete terms, the technology disclosed in Japanese Patent Application Laid-Open No. 2000-122598 is a technology related to brightness variation correction using a correction value for each gradation value, and the technology disclosed in Japanese Patent Application Laid-Open No. 2001-350442 is a technology for providing correction values for specific gradations and calculating the correction value of a gradation value between the specific gradations using interpolation.

The technology disclosed in Japanese Patent Application Laid-Open No. H11-202827 is a technology for suppressing the generation of uneven color of longitudinal lines between blocks which are generated when correction values for a block is determined based on the pixel at the center of the block, and is not a technology for decreasing the gradation-dependent brightness variation.

SUMMARY OF THE INVENTION

The present invention provides a technology for implementing a decrease of the processing band of a storage unit, which is required for reading correction data used for processing to decrease gradation-dependent brightness variation from the storage unit, without dropping brightness variation correction performance.

An image display apparatus according to the present invention includes:

a display panel having a plurality of display elements disposed in a matrix form;

a storage unit that stores correction data for each display element used in correction processing for decreasing brightness variation among the plurality of display elements, including N (N is an integer of 3 or more) number of correction values corresponding to N number of gradation values for each display element;

a correction unit that reads the correction data from the storage unit and executes the correction processing; and a control unit, wherein the control unit divides the display panel into a plurality of sub-areas, calculates, for each sub-area, a select block gradation value which is a gradation value representing the sub-area, and executes, for each sub-area, control to read n (n is an integer of 1 or more and less than N) number of correction values, which are used for calculating a correction value corresponding to the select block gradation value, out of the N number of correction values of each display element in the sub-area, using the correction unit, and the correction unit calculates, for each sub-area, a correction value corresponding to the select block gradation value using the n number of read correction values, and converts gradation values of video signals for display elements in the sub-area using the calculated correction value.

A method for controlling an image display apparatus, according to the present invention, which includes a display panel having a plurality of display elements disposed in a matrix form, a storage unit that stores correction data for each display element used in correction processing for decreasing brightness variation among the plurality of display elements, including N (N is an integer of 3 or more) number of correction values corresponding to N number of gradation values for each display element, a correction unit that reads the correction data from the storage unit and executing the correction processing, and a control unit, the method includes the steps of:

the control unit dividing the display panel into a plurality of sub-areas and calculating, for each sub-area, a select block gradation value which is a gradation value representing the sub-area;

the correction unit reading n (n is an integer of 1 or more and less than N) number of correction values, which are used for calculating a correction value corresponding to the select block gradation value, out of the N number of correction values of each display element in the sub-area; and the correction unit calculating, for each sub-area, a correction value corresponding to the select block gradation value using the n number of read correction values, and converting gradation values of video signals for display elements in the sub-area using the calculated correction value.

According to the present invention, decrease of the processing band of the storage unit, which is required for reading correction data used for processing to decrease gradation-dependent brightness variation from the storage unit, can be implemented without dropping brightness variation correction performance.

Further features of the present invention will become apparent from the following description of exemplary embodiments with reference to the attached drawings.

BRIEF DESCRIPTION OF THE DRAWINGS

FIG. 10 shows an example of patterns which indicate a same block gradation value;

DESCRIPTION OF THE EMBODIMENTS

Figure 1:
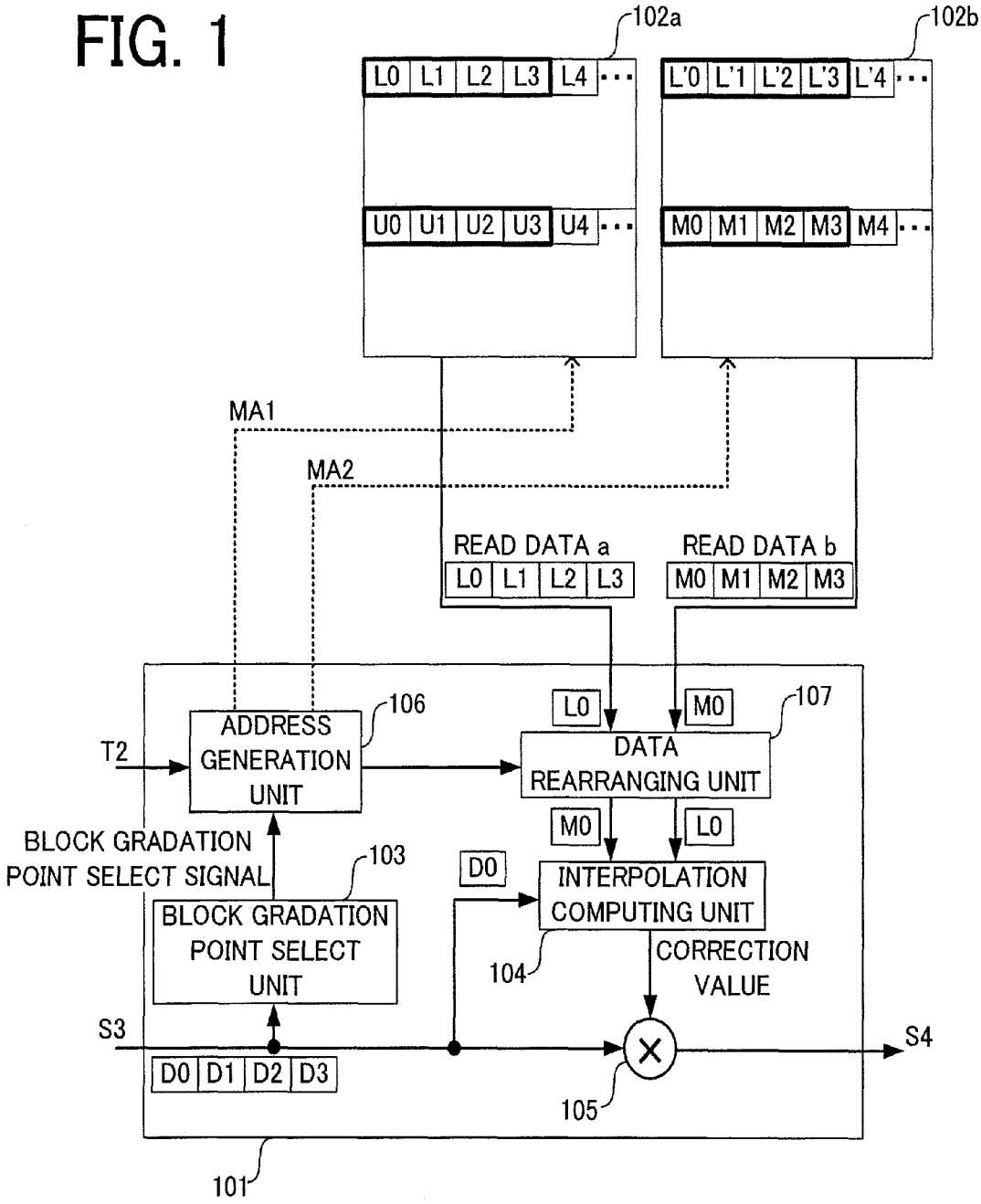
FIG. 1 is a block diagram depicting an example of a configuration of a brightness variation correction unit of the present embodiment.

According to the present invention, a decrease of the processing band of storage unit (memory), which is required for reading correction data used for correction processing from the storage unit, can be implemented without dropping the brightness variation correction performance. The correction processing is processing for decreasing the gradation-dependent brightness variation (brightness variation among a plurality of display elements).

The drive (modulation) method of the image display apparatus is not particularly limited, but a drive method for controlling the voltage waveform is preferable due to the brightness variation dependency on the gradation value (possibility of an increase of the processing band of memory, which is required for reading the correction data from memory for computing, is high). For example, an active matrix type driving system or a simple matrix type driving system is preferable. More specifically, a voltage driving type pulse width modulation system (PWM), a pulse amplitude modulation system (PHM), a system combining PWM and PHM, or a current driving system (since the voltage waveform applied to the display element ultimately varies) is preferable. A PHM system, a system combining PWM and PHM, or the like, in which an amplitude (a field intensity) of a modulation signal is modulated in accordance with the gradation value, is particularly preferable due to the pronounced gradation dependency of the brightness variation.

There are no particular limitations on the type of display element used in the present invention. For example, electron-emitting devices, EL elements, liquid crystal elements, plasma elements, and so on may be used. Electron-emitting devices, EL elements, and so on, in which the brightness is controlled by the field intensity, may be used particularly favorably from the viewpoint of the gradation dependency of the brightness variation. Surface conduction type electron-emitting devices, Spindt type electron-emitting devices, MIM type electron-emitting devices, carbon nanotube type electron-emitting devices, and BSD type electron-emitting devices, for example, may be used as the electron-emitting devices.

In a large-screen image display apparatus using a plurality of display elements, light emission characteristic variation among the plurality of display elements tends to be large, and therefore brightness unevenness (brightness variation) is more likely to occur. Therefore, the present invention is applied favorably to a large-screen (a screen having a diagonal size of at least 20 inches) image display apparatus using a plurality of display elements.

The brightness variation increases as the gradation decreases, so in the case of an image display apparatus in which gradation performance in a low gradation area (area in which gradation value is small) has been improved using electron-emitting devices, it is necessary to provide a large amount of correction data for the low gradation area, and the required processing band of memory increases. Therefore it is preferable to apply the present invention to an image display apparatus with excellent low gradation performance, which has 10 bits or higher gradation performance and high dark area contrast, since brightness variation in a low gradation area must be decreased by correction.

In the high definition image display apparatus having electron-emitting devices, if frame frequency is the same, then the time allocated to one display element for correcting video signals is shorter as the resolution increases. As a result, the required processing band of memory also increases. Therefore a high definition (e.g. such high resolution standards as 2K1K and 4K2K) image display apparatus using electron-emitting devices is a preferable mode for applying the present invention.

Furthermore according to the present invention, the correction data is read in block units in order to decrease the required processing band of memory. Therefore a configuration in which a volatile memory for storing data is accessed at high-speed, is a most preferable mode to which the present invention is applied, since data is read in block units.

EXAMPLE 1

Now an image display apparatus according to Example 1 of the present invention and a control method thereof will be described. In this example, a case of using an electron-emitting device as the display element, and driving the electron-emitting devices by single matrix driving using a modulation method including PWM, is described. However, as mentioned above, the present invention is not limited to this configuration. In this example, it is assumed that the correction data includes N (N is an integer of 3 or more) number of correction values which correspond to N number of gradation values for each display element.

Figure 2:
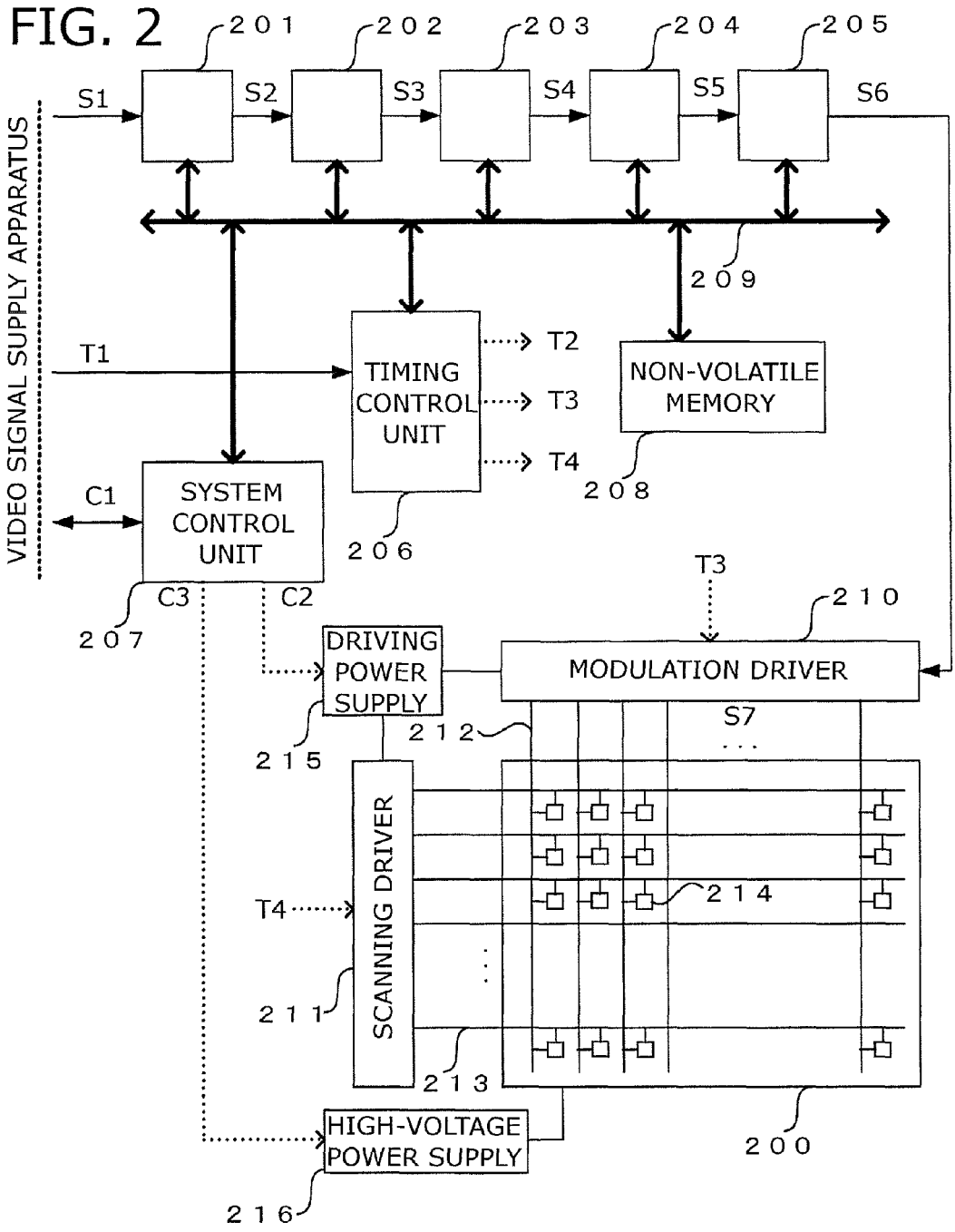
FIG. 2 is a block diagram depicting an example of a configuration of an entire display apparatus of the present embodiment.

FIG. 1 and FIG. 2 are the main diagrams depicting the image display apparatus according to this example and the control method thereof. FIG. 1 is a block diagram depicting an example of a configuration of a brightness variation correction unit, which is a characteristic of this example, and FIG. 2 is a block diagram depicting an example of the configuration of the entire image display apparatus according to this example.

(Overall Description of Image Display Apparatus)

First, the functional constitution of the image display apparatus according to this embodiment will be described using FIG. 2.

A reference numeral 200 denotes a display panel. The display panel includes a plurality of display elements disposed in a matrix form. In this embodiment, a display panel in which a rear plate and a face plate oppose each other via a support member known as a spacer is used as the display panel. The rear plate has a multi-electron source in which the plurality of display elements (cold cathode elements, for example) are arranged in a matrix form (for example, 5759 (=1920×RGB) horizontal direction×1080 vertical direction electron-emitting devices 214). The face plate includes a glass substrate, a plurality of phosphors provided on the glass substrate so as to oppose the plurality of electron-emitting devices, respectively, and a metal back covering the plurality of phosphors.

The plurality of electron-emitting devices 214 are wired into a simple matrix using a plurality of modulation wirings 212 and a plurality of scanning wirings 213. By applying signals from a modulation driver 210 and a scanning driver 211 to the modulation wirings 212 and the scanning wirings 213, electrons are emitted from desired electron-emitting devices. By setting a potential of the metal back at a high potential using a high-voltage power supply 216, the emitted electrons accelerate so as to pass through the metal back and collide with the phosphors. As a result, the phosphors emit light, whereby an image (a video) is displayed. A constitution and a manufacturing method for a display panel having a plurality of electron-emitting devices is disclosed in detail in Japanese Patent Application Laid-open No. 2000-250463, for example.

Next, processing performed in the image display apparatus according to this embodiment, and more particularly processing performed between input of a video signal and display of a video, will be described. The image display apparatus is connected to a video signal supply apparatus and is constituted mainly by two parts, namely a part that performs processing using signals such as a video signal S1 and a synchronization signal T1 and a part that performs processing using a command signal such as a communication signal C1.

First, processing up to a point at which a drive signal S6 input into the modulation driver 210 is generated from the video signal S1 input from the video signal supply apparatus will be described.

The video signal S1 is input into an RGB input unit 201. The RGB input unit 201 includes a conversion circuit for converting the video signal S1 such that a horizontal resolution, a number of scanning lines, a frame rate, a clock frequency, and so on conform to those of the display panel 200, an adjustment circuit for adjusting properties such as a color temperature and a white balance, and so on. The RGB input unit 201 implements predetermined processing on the video signal S1 using the conversion circuit and adjustment circuit, and outputs the result as a signal S2.

The signal S2 is input into an inverse γ correction unit 202. The inverse γ correction unit 202 converts the signal S2 such that a relationship between a brightness value (an output value) on the display panel and a value (data) of the video signal is linear, and outputs the result as a signal S3. The data of the converted signal S3 are proportional to the brightness value, and therefore the data of the signal S3 will be referred to hereafter as "brightness data". Assuming that the video signal S1 is to be displayed by a CRT display apparatus, the video signal S1 is typically subjected to non-linear conversion (gamma conversion) by a power of 0.45 or the like, in accordance with an input-light emission characteristic of the CRT display, and then transmitted or recorded. The inverse γ correction unit 202 implements inverse gamma conversion by a power of 2.2 or the like on the video signal so that the video signal can be displayed on a display apparatus having a linear input-light emission characteristic, such as a FED or a PDP.

The signal S3 is input into a brightness variation correction unit 203 serving as a feature of this embodiment. The brightness variation correction unit 203 implements correction processing for reducing brightness variation (variation in an electron emission characteristic among the plurality of electron-emitting devices 214) on the signal S3 and outputs the result as a signal S4. The brightness variation correction unit 203 will be described in detail below. Note that data of the signal S4 are data in which the brightness variation has been corrected and will therefore be referred to as corrected brightness data hereafter.

The signal S4 is input into a phosphor correction unit 204. The phosphor correction unit 204 implements linearity correction on the signal S4 (the corrected brightness data) taking into account a non-linearity of the modulation driver 210, a brightness saturation characteristic of the phosphors, and so on such that selected display elements emit light at a brightness that is proportional to the corrected brightness data, and outputs the result as a signal S5. In this embodiment, non-self light emitting electron-emitting devices are envisaged as the display elements, and therefore linearity correction is implemented on the signal S4 to ensure that the phosphors opposing the selected electron-emitting devices emit light at a brightness that is proportional to the corrected brightness data. Note that when the brightness saturation characteristic of the phosphors is different for each color of R, G, and B, different conversion (correction) may be implemented on the corrected brightness data for each color.

The signal S5 is input into a drive conversion unit 205. The drive conversion unit 205 rearranges the data (the data of the signal S5) input in RGB parallel to correspond to the arrangement of the RGB phosphors of the display panel 200. Further, the drive conversion unit 205 converts the data of the signal S5 into data conforming to an input format (Mini LVDS, RSDS, and so on, for example) of the modulation driver 210 and outputs the result as the drive signal S6. Note that the data of the signals S4, S5 have values that are proportional to the brightness, whereas the data of the drive signal S6 are non-linear in relation to the brightness.

Note that operation timings of the respective signal processing units (the functions denoted by the reference numerals 201 to 205) are controlled by a synchronization signal T2 generated by a timing control unit 206 on the basis of the synchronization signal T1 received from the video signal supply apparatus.

Further, operating modes of the respective signal processing units (the functions denoted by the reference numerals 201 to 205) are controlled by a system control unit 207 by setting parameters via a system bus 209. The system control unit 207 may be constituted by logic alone or by a CPU, a microcomputer, and a media processor capable of parallel computing. A program for performing the control may be built into a ROM or transferred from the outside via an input/output interface. The parameters must be stored even when a power supply is interrupted. Therefore, the parameters are stored in a large-volume non-volatile memory 208 represented by a flash memory or the like so that the parameters can be read by the system control unit 207 as required and used to perform setting. The non-volatile memory 208 is not limited to a NAND type or a NOR type flash memory, and may be a ROM or a hard disk. Alternatively, a constitution in which a volatile memory such as an SRAM is battery-driven and thereby used as a non-volatile memory may be employed.

Further, the system control unit 207 receives various requests, such as an activation request and an operating mode switch request, from the video signal supply apparatus side via the communication signal C1, and in the absence of an error controls the image display apparatus in accordance with the received request. When an error occurs, the system control unit 207 notifies the video signal supply apparatus side thereof and performs error processing (a forcible shutdown or the like) on the image display apparatus as a failsafe.

Next, processing performed from a point at which the drive conversion unit 205 outputs the drive signal S6 to a point at which the display panel 200 is driven to perform video display will be described.

The modulation driver 210 receives the drive signal S6 from the drive conversion unit 205. Then, on the basis of a timing control signal T3 from the timing control unit 206, the modulation driver 210 applies a modulation signal to the modulation wirings 212 in each selection period during which a scanning wiring is selected by the scanning driver 211.

The scanning driver 211 selects lines (scanning wirings) sequentially in accordance with a timing control signal T4 from the timing control unit 206, and applies a predetermined selection signal to the selected scanning wiring during a corresponding selection period.

A driving power supply 215 supplies power for driving the modulation driver 210 and the scanning driver 211 to them.

Hence, the modulation driver 210 drives the modulation wiring 212 using a modulation signal corresponding to the drive signal S6, and at the same time, the scanning driver 211 outputs a selection signal (a scanning pulse) to the scanning wiring 213. As a result, the electron-emitting device 214 connected to the selected scanning wiring 213 and the modulation wiring 212 to which the modulation signal is applied performs electron emission corresponding to the modulation signal applied to the modulation wiring 212.

The high-voltage power supply 216 generates an acceleration voltage (8 to 10 kV), and the potential of the metal back is set at a high potential by the acceleration voltage. As a result, electrons emitted from the electron-emitting device accelerate so as to collide with the phosphor. When the electrons collide with the phosphor, the phosphor emits light.

By selecting all of the scanning wirings sequentially and performing the processing described above, an image corresponding to a single screen is formed (displayed) on the display panel 200.

Note that the driving power supply 215 and the high-voltage power supply 216 are preferably constituted so that adaptive control can be executed thereon using control signals C2, C3 from the system control unit 207. It is particularly preferable to control a driving sequence of the respective power supplies according to an appropriate startup/shutdown sequence and to control a boosting method and a step-down method for the high-voltage power supply during activation, when the power supply is switched OFF, and when an error occurs.

(Description of Need for Multi-value Correction)

Next, reasons why multi-value correction is required in the brightness variation correction unit 203 will be described. Multi-value correction is correction processing using correction values corresponding to at least two gradation values, which is executed in relation to brightness variation that differs for each gradation value.

First, an example of the modulation signal output by the modulation driver 210 will be described. An emission current of the electron-emitting device can be controlled in accordance with an applied driving voltage, and therefore the brightness can be controlled in accordance with the pulse amplitude of the modulation signal. The brightness can also be controlled in accordance with the pulse width of the modulation signal.

Figure 3:
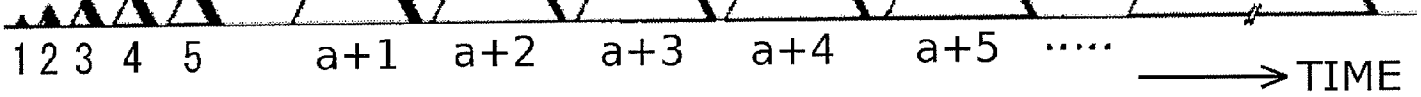
FIG. 3 shows an example of a modulation method of a modulation signal.

In this embodiment, a case in which the display panel is driven using a system of modulating both the pulse width and the pulse amplitude, such as that shown in FIG. 3, will be described. In FIG. 3, waveforms (drive waveforms, corresponding to S7 in FIG. 2) of modulation signals corresponding to respective gradation values are arranged horizontally with the ordinate showing the potential and the abscissa showing time. Here, the gradation values are numbered in ascending order of a signal level that can be taken by the modulation signal, and correspond to the drive signal S6 output by the drive conversion unit 205.

In this type of modulation system, a gradation performance at a subject gradation value improves steadily as a difference in pulse width and pulse amplitude between the drive waveform of the subject gradation value and drive waveforms corresponding to front and rear gradation values decreases. Further, in this modulation system, the aforementioned difference can be reduced in a low brightness region (a low gradation region; a region having small gradation values) in comparison with a PWM modulation system in which the pulse amplitude is fixed. As a result, the number of gradation values in the low gradation region can be increased (the gradation performance can be improved in the low gradation region). However, in this modulation system, the pulse amplitude decreases on the low gradation side in comparison with normal PWM, leading to an increase in brightness variation on the low gradation side. This gradation dependency of the brightness variation will be described in detail below.

Figure 4:
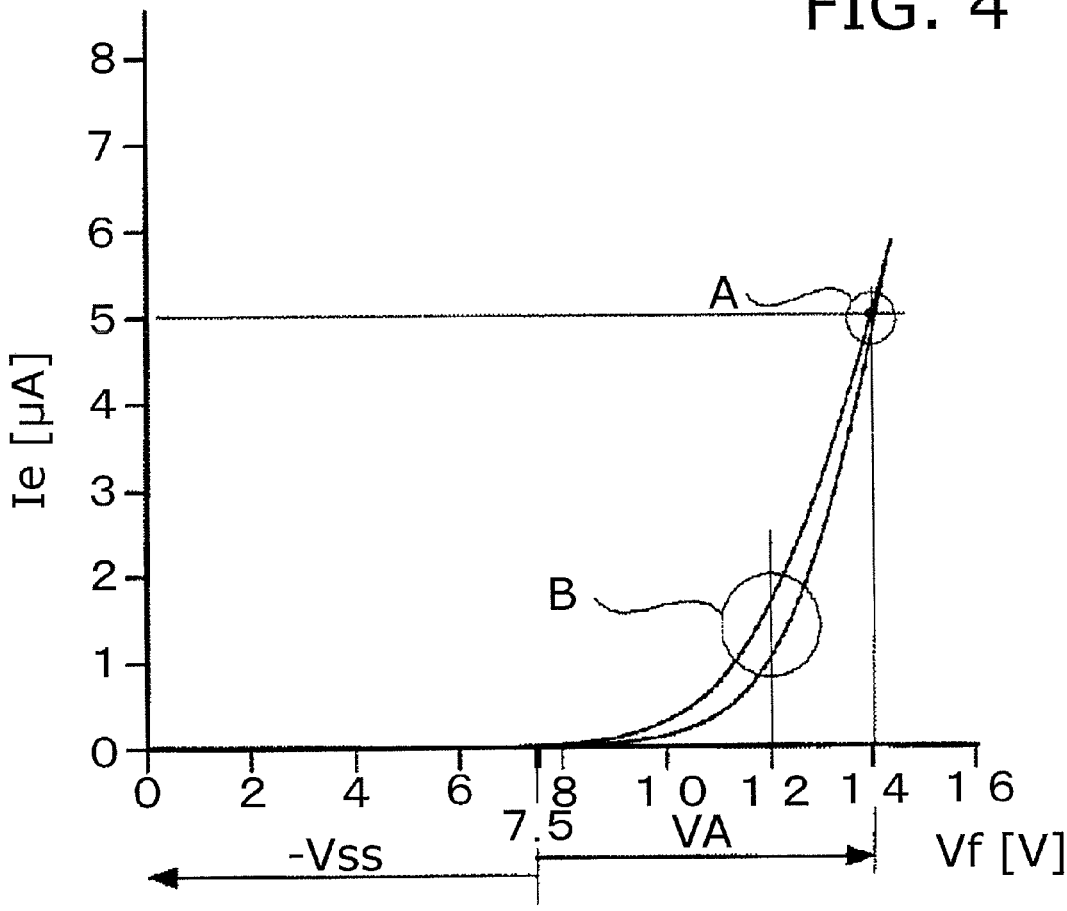
FIG. 4 is a graph depicting an example of characteristics of an electron-emitting device.

Through committed research, the present inventors learned that a major cause of brightness variation is emission current variation among the plurality of electron-emitting devices. FIG. 4 is a graph showing in pattern form a characteristic of the electron-emitting device, on which the abscissa shows the driving voltage and the ordinate shows the emission current. The driving voltage is a voltage (Vf) applied to the electron-emitting devices 214, and corresponds to a difference between a potential (−Vss) of the selection signal and a potential (VA) of the modulation signal (Vf=VA+Vss). Further, in FIG. 4, the potential (−Vss) of the selection signal is set at −7.5 V and a maximum value of the potential (VA) of the modulation signal is set at 7 V. It can be seen from FIG. 4 that electrons are emitted from the electron-emitting devices to which the selection signal is applied in accordance with the potential (VA) of the modulation signal. It can also be seen that no electrons are emitted from the electron-emitting devices to which neither the selection signal nor the modulation signal is applied.

On the actual display panel 200, considerable characteristic variation occurs among the plurality of electron-emitting devices. FIG. 4 shows the characteristics of two electron-emitting devices in pattern form as an example. In FIG. 4, a part indicated by A is a part in which the potential of the modulation signal is high, and therefore emission current values of the two elements are comparatively closely aligned. Apart indicated by B is a part in which the potential of the modulation signal is lower than that of the part A, and therefore the emission current values of the two elements deviate (vary) greatly from each other. Further, at a driving voltage between the part A and the part B, the emission current values of the two elements deviate to a greater extent than in the part A but not as greatly as in the part B. This variation in the emission current value causes brightness variation among the plurality of display elements. Furthermore, the gradation dependency of the brightness variation is due to the fact that the degree of variation in the emission current value differs according to the value of the driving voltage.

Further, when a number of emission points (a number of positions in which electrons are emitted) varies among the plurality of electron-emitting devices, the respective electron-emitting devices have a characteristic obtained by multiplying the ordinate of FIG. 4 by a constant (a ratio of the number of emission points), and therefore the brightness variation exhibits substantially no gradation dependency. When an electric field multiplication coefficient of the electron-emitting device (a shape and a distance between an emitter and a gate) varies, on the other hand, the respective electron-emitting devices have a characteristic obtained by multiplying the abscissa of FIG. 4 by a constant (a ratio of a driving field), and therefore the brightness variation exhibits pronounced gradation dependency. Hence, when the number of emission points and the electric field multiplication coefficient vary independently, brightness variation relationships among the plurality of gradation values vary according to the content of the variation in the number of emission points and the variation in the electric field multiplication coefficient. Therefore, to obtain an accurate correction value, the brightness variation must be measured with regard to at least two gradation values. Furthermore, since the brightness variation may be gradation-dependent, the correction values of the respective display elements must be set for each gradation value.

Hence, multi-value correction is required for the reasons described above.

However, when correction values are prepared for each of the display elements in relation to all of the gradation values, a massive increase occurs in the data volume, and therefore this method cannot realistically be put into practice using hardware. Hence, in this embodiment, several representative gradation values are selected from the gradation values, and the correction values corresponding to the remaining gradation values are generated using a correction value curve obtained by interpolating the correction values corresponding to the representative gradation values.

Figure 5:
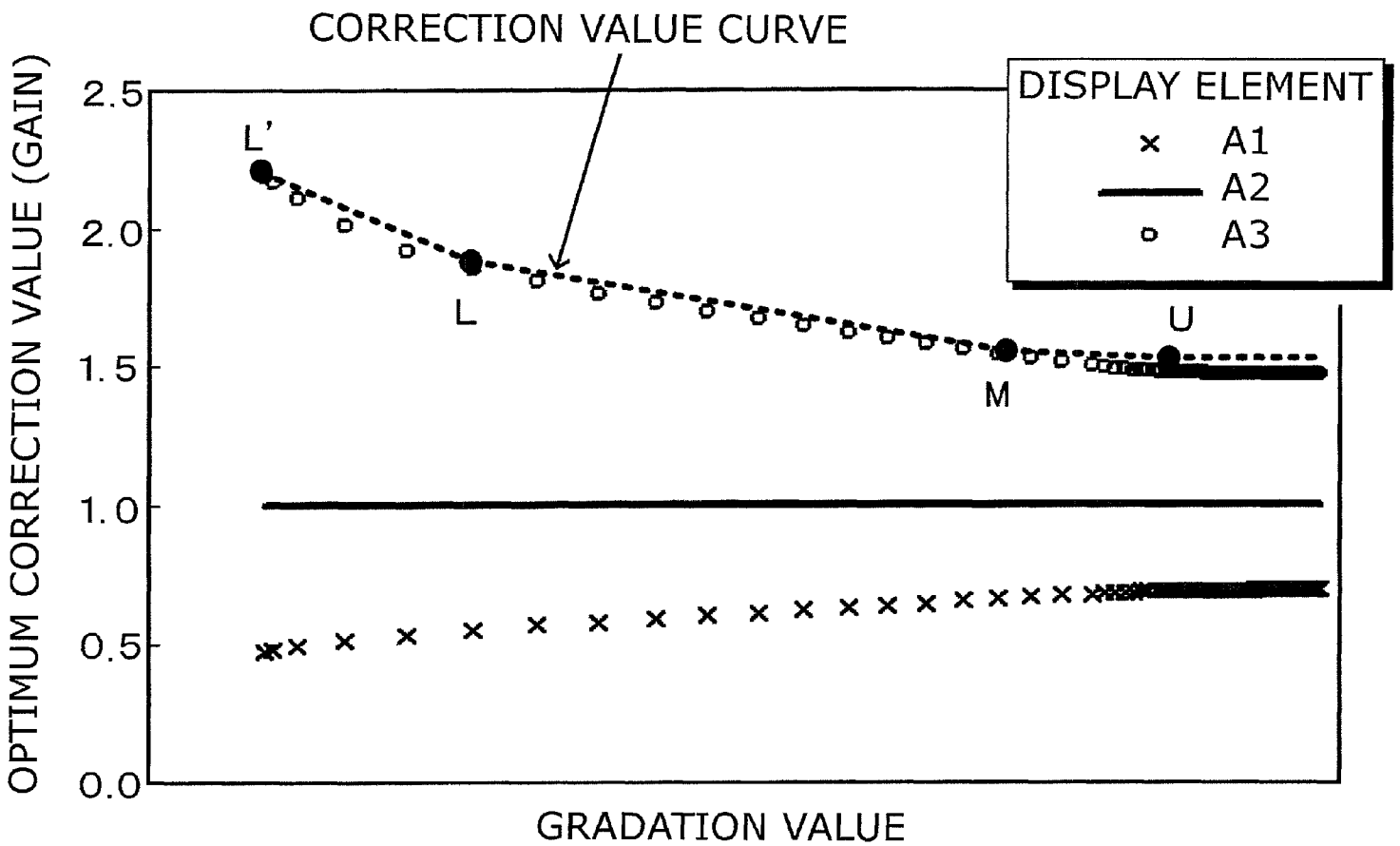
FIG. 5 is a graph depicting an example of a gradation dependency of a correction value.

FIG. 5 shows the gradation dependency of the correction values in a case where gradation values of a display element A1 and a display element A3 are corrected so as to align with the brightness of a display element A2.

FIG. 5 shows a case in which plot points of the display element A3 are set as ideal values and approximation values of ideal values are obtained by interpolating four correction values (a U (Upper) point, an M (Middle) point, an L (Lower) point, and an L' (Lower') point) corresponding to four representative gradation values. However, in the example of FIG. 5, the correction values are interpolated linearly, and therefore the correction value curve includes an error (an interpolation error; in other words, a deviation occurs between the ideal value and the value obtained from the correction value curve). To reduce the error in the correction value curve, the number of representative gradation values must be increased to a certain extent.

(Specific Example of Multi-value Correction)

Figure 6:
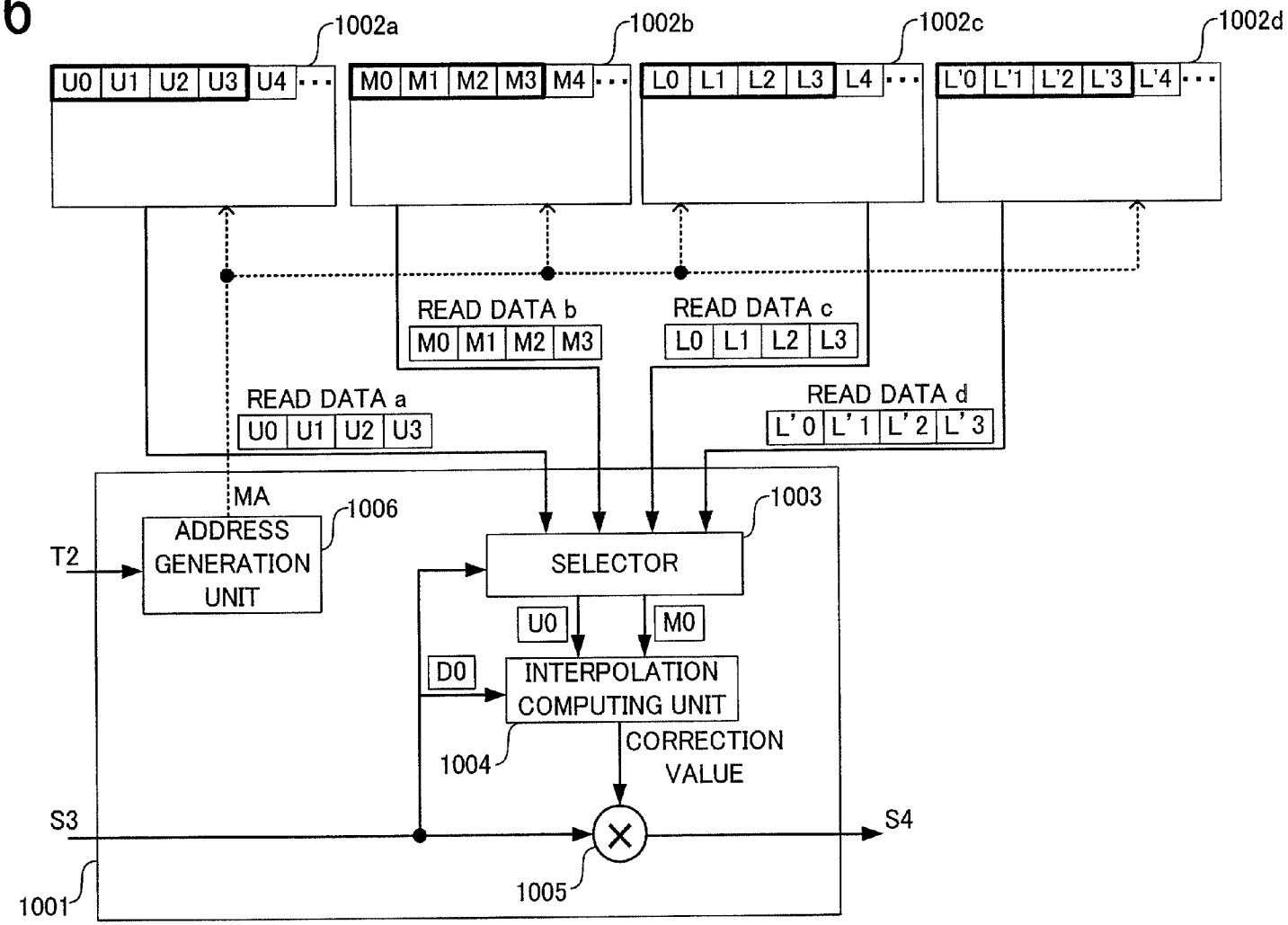
FIG. 6 is a block diagram depicting a configuration of a conventional brightness variation correction unit.

A hardware configuration (prior art) for realizing multi-value correction using a correction value curve such as that described above will now be described with reference to FIG. 6. FIG. 6 is a block diagram showing in detail the brightness variation correction unit 203. FIG. 6 is broadly divided into two processing systems, namely a correction data writing/transfer processing system and a correction data reading/calculation processing system. Each processing system will be described in detail below.

Correction Data Write Transfer Processing System

This processing system is provided for transferring the correction data from a slow non-volatile memory to a fast volatile memory as a pre-stage of executing brightness variation correction. In concrete terms, at startup the system control unit 207 opens a system bus 209 to the brightness variation correction unit 203. When this preparation completes, the system control unit 207 continuously reads the correction data stored in the non-volatile memory 208 to the brightness variation correction unit 203, whereby the correction data is transferred to the volatile memories 1002*a* to 1002*d* in FIG. 6. This transfer is normally called a "DMA transfer".

Generally the volatile memories 1002*a* to 1002*d* are composed of DRAM and SRAM, such as SDRAM and DDR2-SDRAM, which are inexpensive and can operate at high-speed.

In the case of the example in FIG. 6, it is assumed that four correction values corresponding to the four gradation points shown in FIG. 5 are transferred to each display element as the correction data. In concrete terms, the correction value at point U is written in volatile memory 1002*a*, the correction value at point M is written in volatile memory 1002*b*, the correction value at point L is written in volatile memory 1002*c*, and the correction value at point L' is written in volatile memory 1002*d*. In the case of the example in FIG. 6, a data band, which allows reading the four correction values corresponding to the four gradation values simultaneously, is provided.

(Correction Data Reading/Calculation Processing System)

This processing system is provided to implement brightness variation correction on an input video signal while referencing the volatile memories 1002*a* to 1002*d*. More specifically, a multi-value correction calculation unit 1001 corrects the gradation values of the signal S3 using a correction value curve obtained by interpolated correction values read from the volatile memories 1002*a* to 1002*d*, and outputs the result as the signal S4.

When all correction data are transferred to the volatile memories 1002*a* to 1002*d*, the system control unit 207 instructs the multi-value correction computing unit 1001 to start multi-value correction. The multi-value correction computing unit 1001 reads the four correction values (read data a to d) corresponding to the four gradation values simultaneously from the volatile memories 1002*a* to 1002*d* in burst mode, synchronizing with the synchronization signal T2 from the timing control unit 206. In concrete terms, the correction values are read by the address generation unit 1006 outputting the read address MA. Burst mode here refers to a mode for batch processing data in continuous addresses from specified addresses, and a number of the correction values that can be read continuously are determined depending on the structure of the volatile memories 1002*a* to 1002*d* (DRAM). For example, in the example of FIG. 6, DDR2, of which the I/O structure is a 4-bit pre-fetch system, is described, so the burst count is 4. This means that correction values are read in 4-element units upon one address specification. The selector 1003 selects at least two correction values required for multi-value correction out of the four correction values corresponding to the four gradation values which were read above, and transfers the selected correction values to the interpolation computing unit 1004. In the drawings, D indicates brightness data. U, L, L' and M indicate correction values of point U, point L, point L' and point M respectively.

An example of a selection method employed by the selector 1003 will now be described with reference to FIG. 5.

When a gradation value of the signal S3 (the brightness data) is a gradation value between the gradation values of the U point and the M point, the selector 1003 selects the U point and the M point. When the gradation value is between the gradation values of the M point and the L point, the selector 1003 selects the M point and the L point. When the gradation value is between the gradation values of the L point and the L' point, the selector 1003 selects the L point and the L' point. The selector 1003 selects the U point when the gradation value is larger than the gradation values of the U point and selects the L' point when the gradation value is smaller than the gradation value of the L' point.

A calculation method employed by the interpolation calculation unit 1004 will now be described specifically.

A case in which the gradation value of the brightness data is set as din and din is between the gradation values of the M point and the L point will be described. Assuming that coordinates of the M point are (m_th, m_coef) and coordinates of the L point are (l_th, l_coef), a correction value dout (an interpolated correction value) corresponding to the gradation value din can be calculated using a following equation.

$$\begin{aligned} dout &= (1/(\text{m_th} - \text{l_th})) \times \\ &\quad ((\text{m_coef} - \text{l_coef}) \times din + \text{m_th} \times \text{l_coef} - \text{l_th} \times \text{m_coef}) \\ &= (1/(\text{m_th} - \text{l_th})) \times (\text{l_coef} \times (\text{m_th} - din) + \\ &\quad \text{m_coef} \times (din - \text{l_th}) \ \ (\text{where } \text{l_th} < din < \text{m_th}) \end{aligned}$$

By multiplying the correction value dout by the brightness data in a multiplication unit 1005, corrected brightness data (the signal S4) are obtained. Hence, when the correction value is 1, the brightness data are output as is, when the correction Value is smaller than 1, correction is performed to reduce the gradation value (reduce the brightness), and when the correction value is larger than 1, correction is performed to increase the gradation value (increase the brightness). Note that the correction value may be calculated using a similar method when the value of din is a gradation value between the gradation values of the U point and the M point or the L point and the L' point. Further, when the value of din is not a gradation value between the gradation values of U point and L' point, the U point or the L' point which is selected may be set as the value of dout.

(Problem of Hardware Configuration for Multi-value Correction)

Problems of the above mentioned hardware configuration for implementing multi-value correction (prior art) will now be described.

In the brightness variation correction according to prior art, for each display element, a correction value corresponding to the brightness data (gradation value) of the element (in concrete terms, n number of correction values (n is an integer of 1 or more and less than N, n=2 in this example) used for calculating the correction value) is selected. In the case of brightness variation correction for a high definition image (2K1K image) as in the HD standard for digital TV, high-speed data processing is essential. The correction data requires large capacity by using multi-values for the correction values.

Therefore in order to read large capacity correction data from memory at high-speed, an inexpensive DRAM, which can increase transfer efficiency for each address and support the above mentioned burst mode, is normally used as the work memory.

To select correction values corresponding to brightness data, a random access performance which reads only the corresponding correction values, is demanded upon reading the correction data from the DRAM. With DRAM however, transfer efficiency drops if random access is performed due to the DRAM structure. A single access mode of DRAM or SRAM could be used to implement random access, but access time is restricted, and the capacity of data which can be transmitted during a predetermined transfer cycle is small (band is low), which makes this method inappropriate. Another method is to increase the functions of the memory IC, and perform parallel processing to increase the band, but this increases the mounting area of the memory IC, and increases cost, therefore this method is also inappropriate.

With the foregoing in view, the prior art uses DRAM in burst mode in order to increase transfer efficiency and to support high-speed processing. Also a function equivalent to random access is implemented by using a configuration to read all the correction values which may be selected, the selector 1003 selecting correction values according to the brightness data.

However in prior art, the weak points of the configuration become more obvious as display panels 200 improve in future, such as a "gradation performance improvement" and "higher definitions".

Figure 7A:
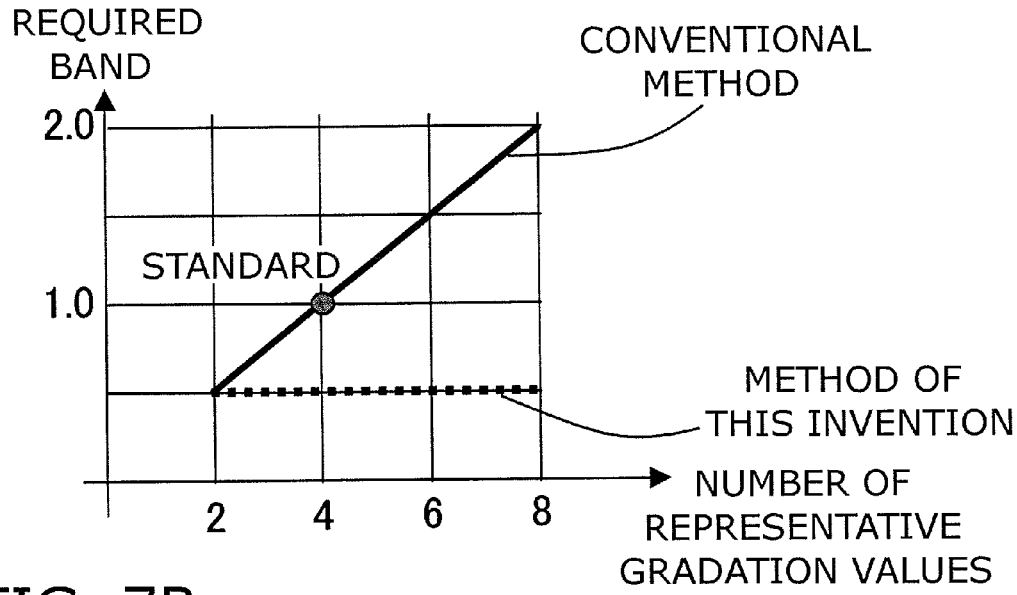
FIG. 7A and FIG. 7B are graphs depicting an example of the difference of the required bands between a conventional method and a method according to the present invention.

In concrete terms, if display performance in a low gradation area is improved, the brightness variation increases more at the lower gradation side, and more values are needed (correction values for more gradation values are required). In the case of prior art, which uses a method of reading correction values for all the gradation values, the processing band (required band) of the memory required for reading the correction values would increase if the gradation performance is improved. FIG. 7A shows the change of the required band depending on the number of values, when the required band in the current four-value correction (multi-value correction using four correction values corresponding to four representative gradation values) is 1 (in FIG. 7A, the ordinate indicates the required band, and the abscissa indicates a number of representative gradation values). In the prior art (conventional method), a number of representative gradation values is in proportion to the required band, and the required band increases as the low gradation performance improves.

Figure 7B:
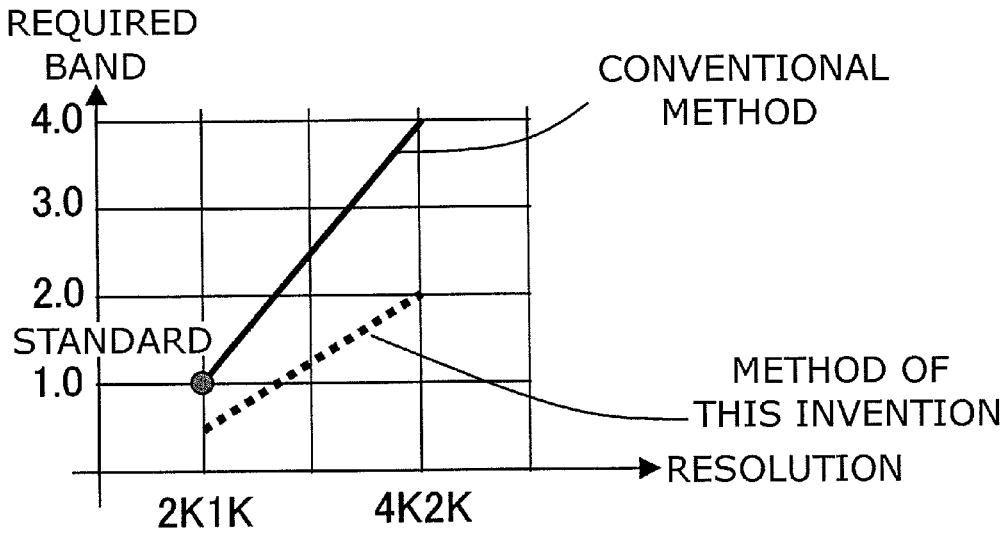

If ultra high definition, such as 4K2K, which supports digital cinema format, is used, the time allocated to correction processing for one display element decreases due to the higher definition if frame frequency is the same, so the required band increases. In other words, the required band increases in proportion to a number of display elements. For example, FIG. 7B shows the change of required band as resolution increases, when the required band of the current 2K1K is 1 (in FIG. 7B, the ordinate indicates a required band, and the abscissa indicates resolution). As FIG. 7B shows, the required band of 4K2K is four times the required band of 2K1K.

In order to support this increase in required band, functions and speed of the volatile memory 1002 in FIG. 6 must be increased. However increasing the functions of volatile memory 1002 increases cost due to the dramatic increase in the number of pins of the LSI for controlling the volatile memory 1002. Concerning increasing speed of the volatile memory 1002, implementing a faster speed that exceeds a certain level is not easy, since device performance of the volatile memory 1002 is limited, and the difficulties in substrate design increase.

Hence according to this example, instead of the selector 1003 selecting two representative gradation values for computing interpolation, out of the four representative gradation values, two representativel gradation values required for computing interpolation are selected in advance, and correction values corresponding to the selected representative gradation values are read from memory.

In the case of the selector 1003 selecting two representative gradation values out of four representative gradation values, waste is generated in the required band (waste due to reading the remaining two representative gradation values (correction values which are not used)), but such waste is not generated in the method of the present invention.

In concrete terms, as FIG. 7A shows, the required band of the present invention is constant regardless the number of representative gradation values (required band when a number of representative gradation values is two). Furthermore in the case of four-value correction, the required band is decreased to ½ of the conventional method, regardless the resolution, as shown in FIG. 7B.

However if the method of the present invention is implemented without wasting the band using a volatile memory (DRAM, SRAM) based on burst mode, the selection unit of the representative gradation value is a block unit such as one block (sub-area) composed of a plurality of display elements, instead of a display element unit. And correction performance must be maintained even if the selection unit is a block unit (correction performance drops if the selection unit is in block units in the case of the conventional method). Therefore in this example, correction performance is maintained by using the following method.

(Brightness Variation Correction Method of this Example)

Concerning the above mentioned switching of the representative gradation values in block units, the present inventor through that if a correction value for the correction target display element is used, the difference of the gradation value and the gradation value of signal S3 may not be detected, even if these gradation values deviate. And after conducting experiments to verify this, the following tendency was discovered.

Image with Low Spatial Frequency

If the image in the block is an image of which correlation is relatively high (e.g. solid in FIG. 10), such as a solid pattern and a nature image of which spatial frequency is low, correction processing using a correction value corresponding to an average gradation value can be executed. If such correction processing is executed, a correction error of each display element in the block is unrecognized in appearance. The average gradation value is, for example, an average value of gradation values (average gradation value), mid value or a mode. The correlation can be regarded as high if a gradation value of each display element in the block is within a certain gradation range (e.g. 10 gradation width), and otherwise is low.

Image with High Spatial Frequency

If the image in the block is an image of which spatial frequency is high, such as a pattern which toggles between a bright area and dark area (e.g. toggle in FIG. 10), a correction error of each display element in the block is unrecognized in appearance, even if the gradation value deviates from the gradation value of signal S3.

Image Including Edge

If the image in the block is an image of which spatial frequency is low, including an edge which changes from a bright area to a dark area (or from a dark area to a bright area) (e.g. edge in FIG. 10), correction processing using a correction value corresponding to the gradation value of a high gradation side area (bright area) constituting the edge is performed (priority given to the bright area). If such correction processing is executed, a correction error of each display element in the block is hardly recognized in appearance. The gradation value of a high gradation side area constituting the edge is, for example, a maximum gradation value, minimum gradation value or average gradation value in the area.

The above mentioned image with high spatial frequency and image including an edge are regarded as images of which correlation is low. In other words, the correction processing using a correction value corresponding to the average gradation value is preferable for an image having high correlation, and correction processing giving priority to the bright area is preferable for an image having low correlation.

Figure 8A:
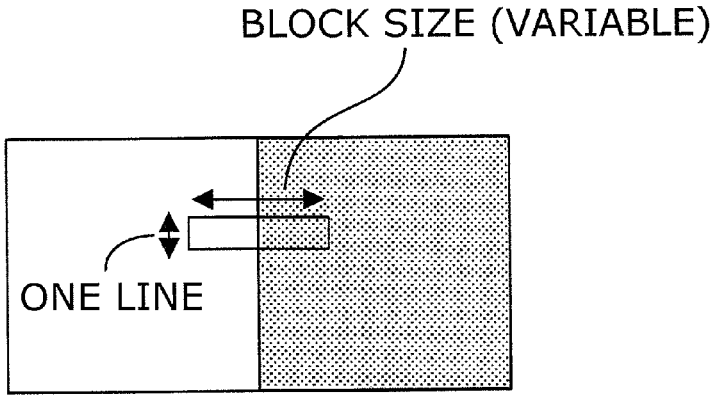
FIG. 8A shows an example of an image.
Figure 8B:
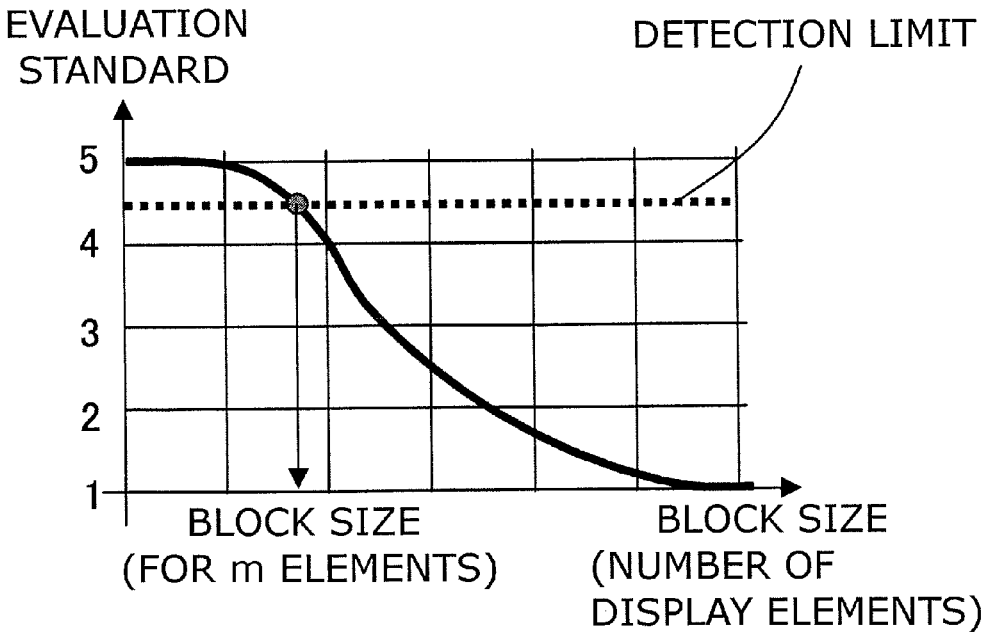
FIG. 8B is a graph depicting a relationship of a block size and detection limit.

Furthermore the present inventor subjectively evaluated the detection limit of correction errors upon changing the block size, using an image of which error (s) could be most easily detected (an image which includes an edge and of which spatial frequency is low), as shown in FIG. 8A. As a result, it was found out that an interpolation error is not detected at all if the block size is less than a certain size (equivalent to m elements), as shown in FIG. 8B, and is easily detected if the block size is more than a certain size (the ordinate in FIG. 8B is an evaluation standard to indicate that the interpolation error can be detected less easily as the value in the ordinate increases). In other words, considering the relationship of the above experiment result and the number of correction values which can be read from the volatile memory 1002 in burst mode, an optimum block size can be determined.

The block in this example is an area of which block size is m elements×1 line, and the unit of the block size in FIG. 8B is indicated as a number of display elements. But actually the block size is not a simple number of elements, an area parameter determined by the relationship of the element pitch (distance between display elements) of the display panel×number of elements and a viewing distance (distance between the display screen and a viewer).

(Block Configuration and Processing of Example 1)

As the above mentioned experiment result shows, both maintaining correction performance and decreasing required band can be implemented by calculating, for each sub-area, a select block gradation value representing the sub-area based on the characteristics (image pattern) of the image in the sub-area.

As mentioned above, the correction processing using a correction value corresponding to an average gradation value is preferable for an image having high correlation, and the correction processing giving priority to the bright area is preferable for an image having low correlation. Therefore according to this example, an average gradation value of the video signal for each display element in the sub-area is calculated as the select block gradation value if the correlation of the image in the sub-area is higher than a predetermined standard. If the correlation of the image in the sub-area is lower than the predetermined standard, the select block gradation value is calculated using a gradation value higher than a predetermined gradation value, out of the gradation values of video signals for the display elements in the sub-area.

This will be described in detail with reference to FIG. 1. First the major difference from the conventional configuration shown in FIG. 6 will be described.

In this example, a configuration of which required band is ½ of the prior art (example in FIG. 6: example of a four-value correction) by not using the selector 1003 in FIG. 6, which generates unnecessary bands, will be described. Therefore according to this example, the volatile memory 102 (storage unit) connected to the multi-value correction computing unit 101 has a two-chip configuration (volatile memories 102*a* and 102*b*), instead of a four-chip configuration. The read addresses MA1 and MA2 to the volatile memories 102*a* and 102*b* (address to indicate correspondence of a gradation value and the correction value to be read) are independently controlled. The address generation unit 106 for generating the read addresses MA1 and MA2 is controlled not only by the synchronization signal T2, but also by a block gradation point select signal from the block gradation point select unit 103. The operation of the block gradation point select unit 103 will be described in detail later.

Now a method for storing correction data to the volatile memories 102*a* and 102*b* based on a characteristic DMA transfer will be described.

In the two ICs of the volatile memories 102*a* and 102*b*, the correction data for all the display elements are stored so that the coefficient pair (two correction values used for computing interpolation) can be read simultaneously.

In concrete terms, correction values (correction value for each display element) of point U and point L are stored in the volatile memory 102*a*, and the correction values of point M and point L' are stored in the volatile memory 102*b*. Therefore any one of the three patterns of point U and point M, point L and point M, and point L and point L' can be read simultaneously. However if correction values are sequentially read from the volatile memories 102*a* and 102*b*, and in the case of reading the correction values of point U and point M, and point L and point L' in the sequence of greater gradation value, the correction values of point L and point M are read in the sequence of smaller gradation value. So the data rearranging unit 107 must swap data only when the correction values of point M and point L are read, using the control from the address generation unit 106. If the correction value of point M is additionally stored in the volatile memory 102*a*, and the correction value of point L is additionally stored in the volatile memory 102*b*, then the memory capacity increases but the point M and point L can be read in the sequence of greater gradation value. In this case, the data rearranging unit 107 is unnecessary.

Figure 9:
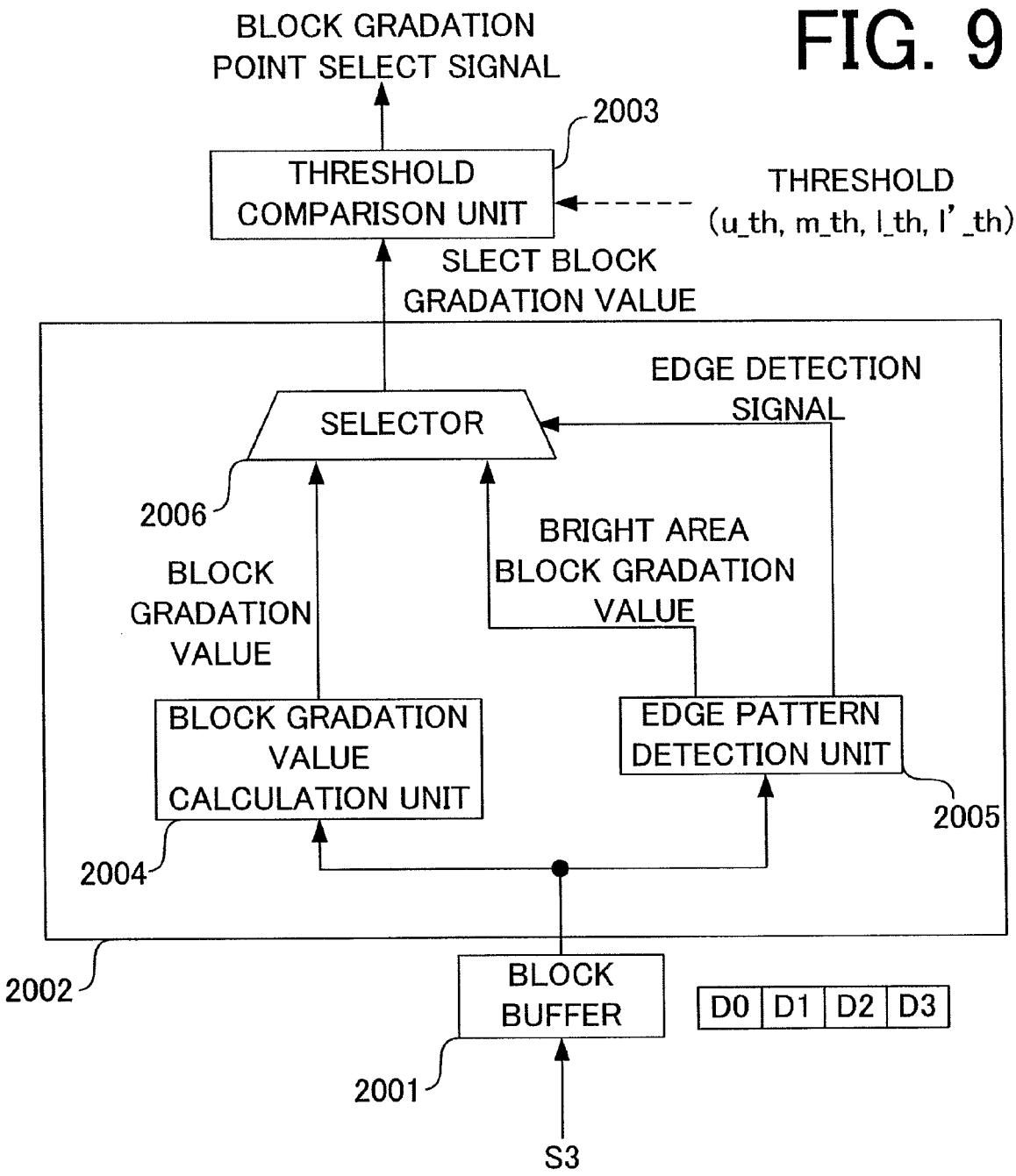
FIG. 9 is a block diagram depicting an example of a configuration of a block gradation point select unit of Example 1.

Now a specific processing flow, until generating the read addresses MA1 and MA2 to the volatile memories 102*a* and 102*b* from brightness data (signal S3), will be described with reference to FIG. 1 and FIG. 9. FIG. 1 is an example of reading continuous correction values for four elements (block size is four elements) by one address, so as to be easily compared with FIG. 6. The processing herein below is executed in block (sub-area) units.

In FIG. 1, the brightness data (signal S3) is input to the block generation point select unit 103 (control unit). The block gradation point select unit 103 divides the display panel 200 into a plurality of sub-areas, and outputs the block gradation point select signal for each sub-area. In concrete terms, four elements constitute one block unit, and a block gradation point select signal is output to the address generation unit 106. The block gradation point select signal is a signal to identify three types of coefficient pairs (point U and point M, point M and point L, and point L and point L') in this example, and the address generation unit 106 generates the read addresses MA1 and MA2 from this signal and the synchronization signal T2.

The operation of the block gradation point select unit 103 will be described first with reference to FIG. 9. The block gradation point select unit 103 consists of three major processing units (block buffer 2001, block pattern analysis unit 2002 and threshold comparison unit 2003).

The brightness data (signal S3) is input to the block buffer 2001. In concrete terms, the brightness data having at least a block size is stored for in-block pattern analysis processing by the block pattern analysis unit 2002. According to this example, when brightness data for four elements are stored, the block buffer 2001 simultaneously transfers the stored data to the block gradation value calculation unit 2004 and the edge pattern detection unit 2005. The block gradation value calculation unit 2004 calculates the average gradation value of the video signals for the display elements in the block (hereafter called "block gradation value"). In concrete terms, the average value of the gradation values for four elements is calculated, and is output to the selector 2006 as a block gradation value. The edge pattern detection unit 2005 analyzes the data pattern of the four elements in the block (in-block pattern analysis processing).

The data pattern is analyzed because different data patterns exist even if the block gradation value is the same. FIG. 10 shows an example of three different types of patterns (solid, edge and toggle) having a same block gradation value. According to this example, the edge pattern detection unit 2005 detects an edge as a characteristic pattern (determines whether the image in the sub-area is an edge pattern image including an edge). If an edge is detected, the edge detection signal is output, and a bright area block gradation value is calculated. The bright area block gradation value is an average gradation value (128) of the high gradation side (side in which gradation value is greater) area (bright area) constituting the edge. An average gradation value (0) of the low gradation side (side in which gradation value is smaller) area (dark area) constituting the edge, on the other hand, is defined as a dark area block gradation value. The bright area block gradation value and the edge detection signal are output to the selector 2006. The bright area block gradation value is calculated when an edge is detected because, as mentioned above, it is more difficult to detect a correction error of each display element in the block in an edge pattern image if priority is given to the bright area.

The selector 2006 normally selects a block gradation value, but selects a bright area block gradation value for a sub-area of an edge pattern image. The selected result is transferred to the threshold comparison unit 2003 as a select block gradation value. In other words, a block gradation value is normally calculated as a select block gradation value, and for a sub-area of an edge pattern image, a bright area block gradation value is calculated as the select block gradation value.

Out of N number of correction values of each display element in the block, the threshold comparison unit 2003 generates and outputs block gradation point select signals which indicate n number of correction values used for calculating a correction value corresponding to the select block gradation value. For example, if the coordinates of point U are (u_th, u_coef), coordinates of point M are (m_th, m_coef), coordinates of point L are (l_th, l_coef), and coordinates of point L' are (l'_th, l'_coef), then the select block gradation value is compared with the gradation value components (thresholds) of these coordinates u_th, m_th, l_th and l'_th. Thereby an optimum coefficient pair is determined, and the block gradation point select signal for identifying the determined coefficient pair is output.

In concrete terms, point U is selected if u_th<select block gradation value, point U and point M are selected if m_th<select block gradation value≦u_th, point M and point L are selected if l_th<select block gradation value<m_th, point L and point L' are selected if l'_th<select block gradation value<l_th, and point L' is selected if select block gradation value<l'_th.

Now a concrete address generation method by the address generation unit 106 will be described.

In the volatile memories 102*a* and 102*b*, four correction values corresponding to four gradation values are stored as correction data by the above mentioned storage method.

If the base addresses of the gradation values are point U: BaseAddr_U point M: BaseAddr_M point L: BaseAddr_L point L': BaseAddr_L' and if the coordinates of the display screen are (0, 0) to (1919, 1079), and the block size is BSIZE, then the read address of each gradation value for the blocks (four elements) at coordinates (X, Y) can be given by $$\text{read address}=\text{base address}+int(X/BSIZE)+1920/BSIZE*Y$$

The address generation unit 106 selects a base address using the block gradation point select signal, and recognizes the coordinates (X, Y) by counting the synchronization signal T2. And if point U and point M are selected for a block in coordinates (X, Y), for example, the read address is generated as in read address MA1=BaseAddr_U+int (X/4)+480*Y read address MA2=BaseAddr_M+int (X/4)+480*Y The read address is not limited to the above mentioned format. Any address can be used if a coefficient pair can be determined.

By controlling the read addresses to the volatile memories 102*a* and 102*b* like this, an optimum coefficient pair (read data a, b) are read to the data rearranging unit 107 according to the read addresses MA1 and MA2. In other words, n number of correction values, which are used for calculating a correction value corresponding to the select block gradation value, are read from the volatile memories 102*a* and 102*b* for each sub-area. The data rearranging unit 107 rearranges the correction values, which were read, if necessary, and transfers these correction values to the interpolation computing unit 104. The interpolation computing unit 104 calculates a correction value corresponding to the select block gradation value using the above mentioned n number of correction values which were read, and the multiplication unit 105 converts the gradation value of the video signal for the display element in the sub-area, using the calculated correction value. In concrete terms, the multiplication unit 105 multiplies the brightness data (signal S3) by the calculated correction value, and outputs the corrected brightness data (signal S4). In an actual system, the above described processing is executed independently for each color, R, G and B. In this example, the correction unit of the present invention is implemented by the data rearranging unit 107, interpolation computing unit 104, and multiplication unit 105.

As described above, in order to decrease the required band in the brightness variation correction processing using volatile memories based on burst mode, a method for selecting in advance two correction values corresponding to two gradation values required for computing interpolation, and reading these correction values from the volatile memories is effective. In this case, the read data (correction values) is in block units, but an apparent correction performance can be maintained by analyzing the data pattern in the block and dynamically selecting an optimum gradation value of which correction error is hardly detected. As a result, both a decrease in required band and maintaining correction performance can be implemented.

In this example, the processing method for the block gradation point select unit 103 normally selecting the block gradation value, and selecting the bright area block gradation value only when an edge is detected, was described, but the processing method is not limited to this.

For example, in order to improve accuracy to detect an edge pattern image which influences correction error detection, the following additional detection conditions may be set.

For example, it may be determined that this image is an edge pattern image if an edge is detected in the image in the sub-area, and if:

- the difference of gradation values between the bright area and dark area constituting the edge is a predetermined value or more, (a correction error can be more easily detected as the difference becomes greater);
- a ratio of the bright area to the dark area constituting the edge is within a predetermined range (a correction error can be most easily detected when dark area: bright area=1:1); or
- a number of existing edges is 1 (to remove a toggle pattern).

Processing may be simplified by selecting a block gradation value for all the sub-areas. But correction may become insufficient if a block gradation value is merely selected, since correlation of the image in the sub-area decreases as the size of the sub-area is larger. Hence in such a case, histogram analysis may be performed for the image in the sub-area, so that a range of gradation of which frequency is highest in the sub-area is selected, and the average value of the gradation values in the range is selected (calculated) as the select block gradation value. Image pattern analysis in a block may be performed with higher precision by combining data pattern analysis, such as spatial frequency analysis, with the histogram analysis, so that the select block gradation value is selected by the above mentioned method based on this result.

Also in this example, high or low correlation is determined based on whether the image in the sub-area includes an edge or not as a standard, but a different appropriate standard may be set according to purpose. For example, a standard to determine whether correlation is high or low may be the distribution profile of a histogram.

Also in this example, the bright area block gradation value is calculated when an edge is detected (that is, when correlation is lower than a predetermined standard), but what is calculated is not limited to the bright area block gradation value. Any value calculated using a gradation value higher than a predetermined gradation value can be used. The predetermined gradation value can be a fixed value or a value which changes according to the block gradation value or histogram.

The above description is only an example, and all methods for selecting a select block gradation value, with which a correction error becomes hard to detect, are included in this invention.

In this example, a case of N=4 and n=1 or 2 was described, but the values of N and n are not limited to this case. For example, N=8 and n=3 (that is out of 8 correction values corresponding to 8 gradation values, 3 correction values are selected and a correction value curve is obtained from the selected 3 correction values), so N and n may be set to whatever are appropriate values.

EXAMPLE 2

In Example 1, an example of a sub-area composed of display elements corresponding to an identical color (R (G, B) block: color block) was described. In Example 2, a processing method which can decrease the block size with a smaller band than Example 1 will be described.

In Example 1, description depending on color was omitted, and a number of times of burst transfer is based on the block size in order to make description simpler. However the brightness data (signal S3) is data for each color, R, G and B respectively, so the method for storing the correction data in memory for determining the block size and access method thereof require the following improvements.

Figure 11A:
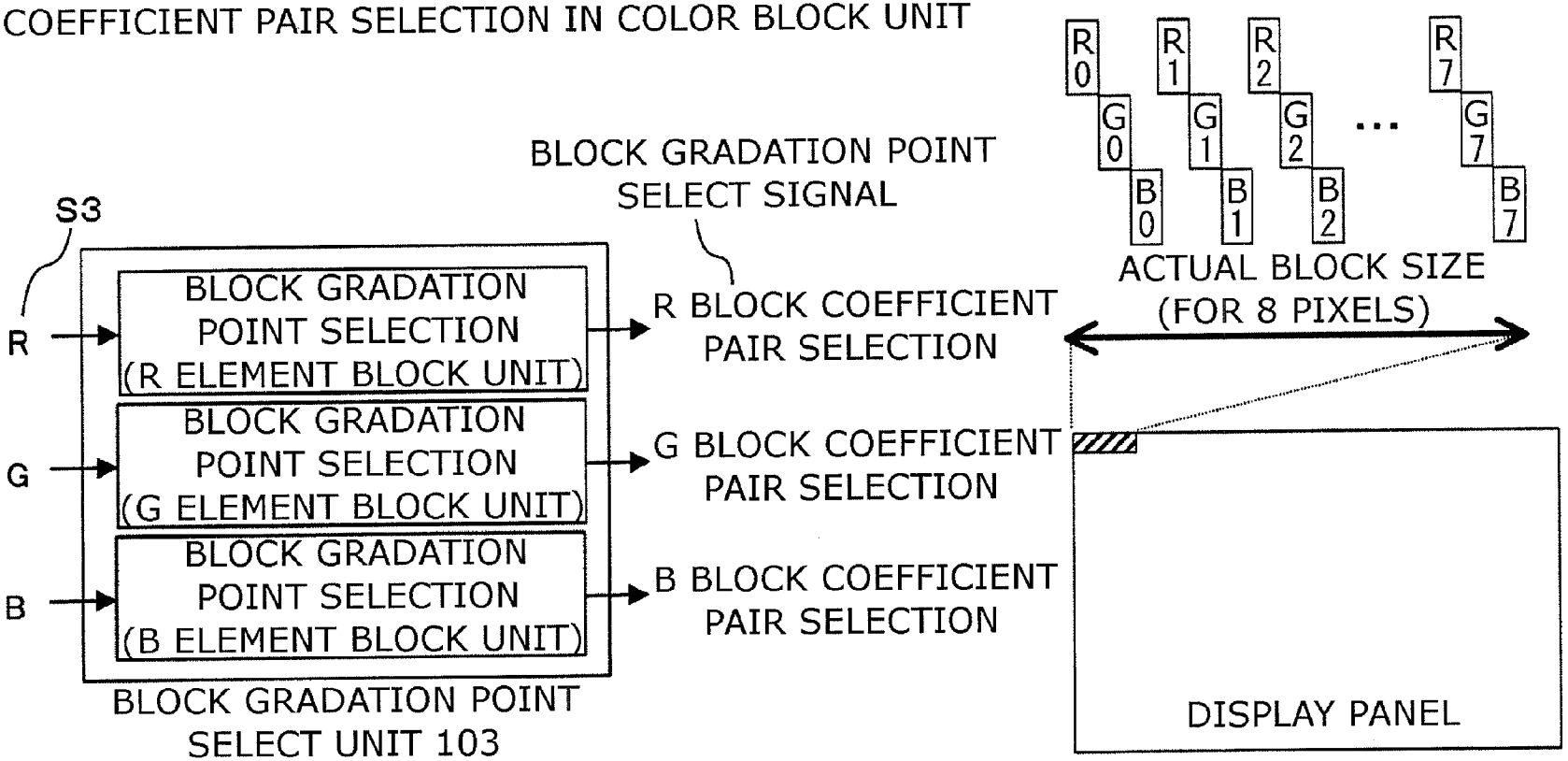
FIG. 11A and FIG. 11B show examples of a coefficient pair selection method.

FIG. 11A shows an image of a coefficient pair selection in the case of processing in color block units. The block gradation point selection unit 103 performs independent processing (block gradation point select processing) for each color, and outputs a block gradation point select signal for each color to the address generation unit 106. The processing content of the block gradation point select unit 103 is the same as the content described in Example 1, but here, areas for eight elements constitute one block. The reason will be described later. The block size in this case is a size for eight pixels, as shown in FIG. 11A. In the display panel, it is assumed that the plurality of display elements are three display elements corresponding to three colors, R, G and B respectively, which are disposed as one pixel.

Figure 12A:
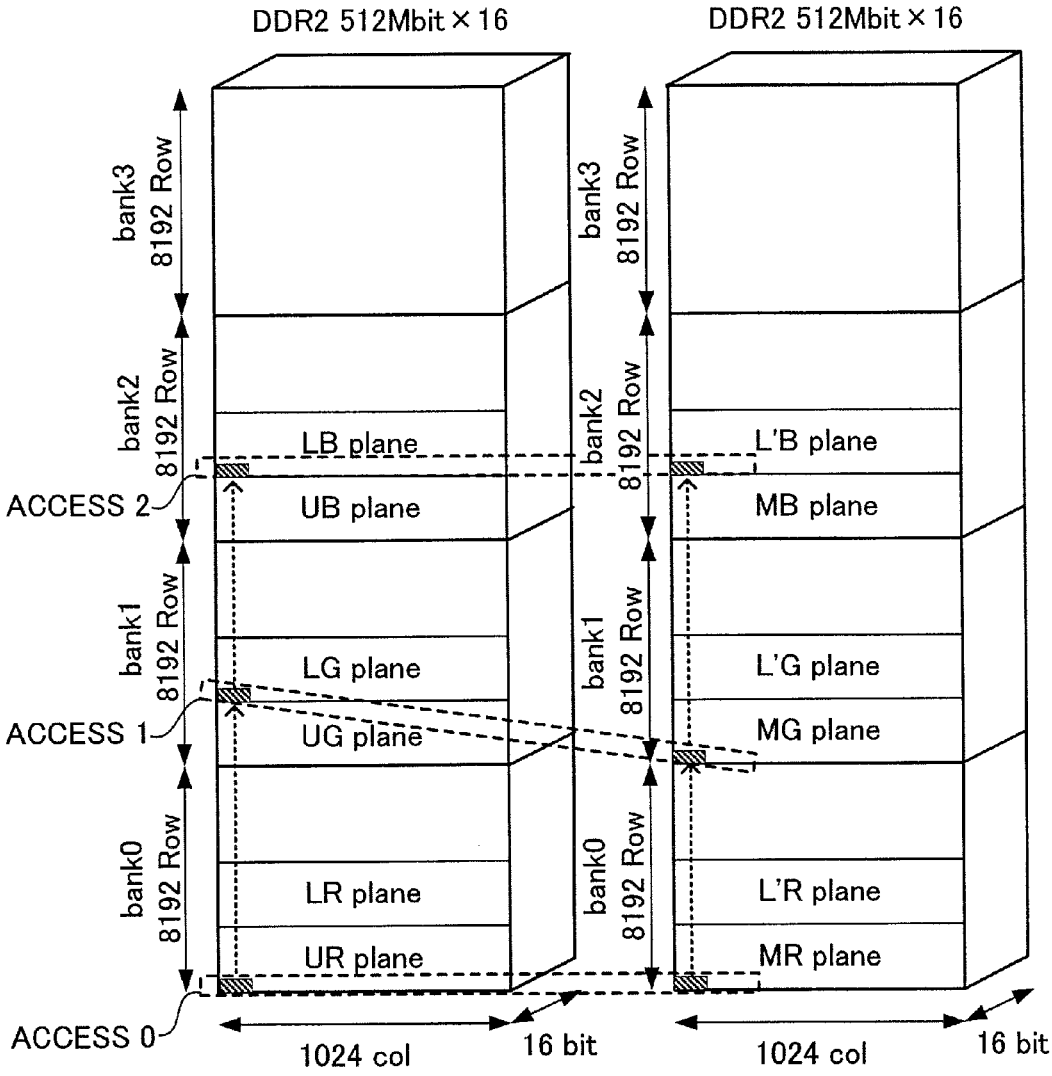
FIG. 12A shows an example of a method for storing correction data in a color block unit and an access method for reading the correction data.
Figure 12B:
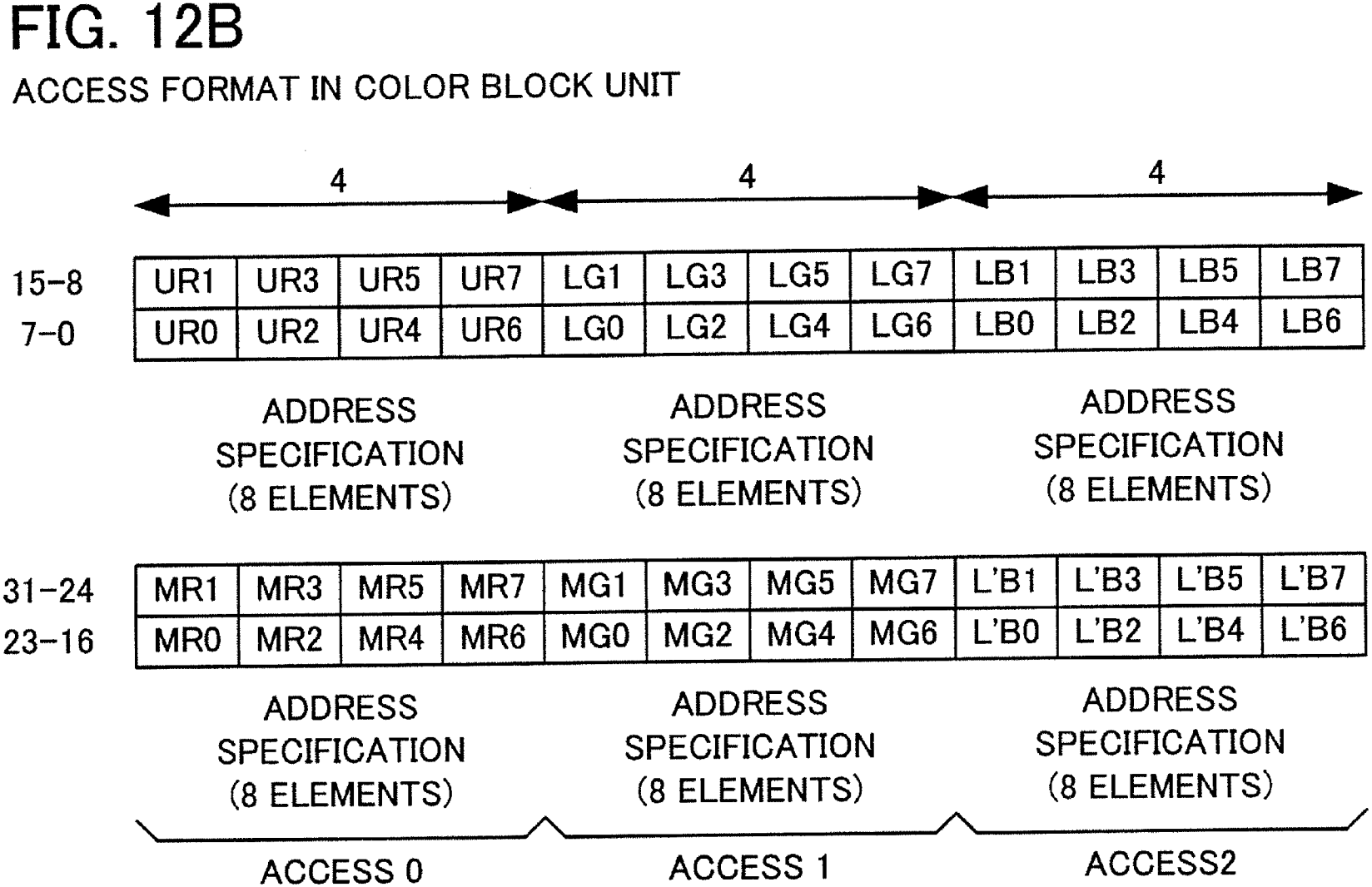
FIG. 12B shows an example of an access method for reading correction data in a color block unit.

Now a method for storing correction data to the volatile memories 102*a* and 102*b* for processing in color block units in FIG. 11A, and an access method thereof, will be described with reference to FIG. 12A and FIG. 12B. In FIG. 12A and FIG. 12B, UR, LR, L' R and MR indicate correction values at point U, point L, point L' and point M corresponding to each display element of color R. UG, LG, L'G and MG or UB, LB, L'B and MB are the same as UR, LR, L'R and MR except that the color of the display element is G or B.

FIG. 12A and FIG. 12B are examples when two DDR2-SDRAMs (512 Mbit×16) are used as the volatile memories 102*a* and 102*b*. FIG. 12A shows a physical address plane when four correction values corresponding to four gradation values are provided. DDR2-SDRAM is a memory having a bank configuration, and the correction data is stored in different banks at least depending on color. The four correction values corresponding to the four gradation values are allocated (stored) by the method described in Example 1.

In order to utilize the band of the memory most efficiently in this allocation to the physical addresses, the access method (access format) becomes as shown in FIG. 12B. In concrete terms, if one correction value has 8 bits/color, a method for utilizing the band of memory most efficiently is to regard an access in the sequence of R, G and B (access 0->access 1->access 2) as a basic access unit, specifying addresses for eight elements for each color. According to this access method, a different bank is accessed upon switching the read address in any case (a control unit accessing the same bank continuously can be prevented). Therefore an efficiency drop due to overhead among accesses to a DDR2-SDRAM is not generated.

In the method in FIG. 12B, the processing band of the memory (memory clock frequency) in the case of driving display panel 200 at 120 Hz is calculated as follows.

Since the dot clock of FHD (Full High Definition) at 60i is 74.25 MHz, the dot clock at 120p is 297 MHz, which is simply the result of multiplying the above value by 4. The memory clock frequency is calculated as memory clock frequency=video clock frequency×transfer capacity×transfer efficiency/memory bus width, so the memory frequency in the case of driving at 120 Hz becomes Memory clock frequency=297 MHz×(8 bits/color×RGB×2 (number of correction values))×1.0/32 bits=445.5 MHz that is, the chip standard DDR2-533 is sufficient.

However if a block size is determined placing importance on the efficiency of the memory band, as described above, the block size becomes a size of eight pixels. As FIG. 8B shows, the smaller the block size the better, so in order to further decrease the block size, the transfer volume per address could be decreased with keeping the burst count at 4. In this case however, transfer efficiency drops and the required band (required memory clock frequency) increases. For example, if the block size is decreased from eight to six pixels (correction values for six elements are transferred for one address), the memory clock frequency is 445.5 MHz×(8/6)=594 MHz, which can be supported if the chip standard is changed from DDR2-533 to DDR2-667. However if the block size is decreased from eight to four pixels, then the memory clock frequency is 445.5 MHz×(8/4)=891 MHz, which cannot be easily supported merely by changing the chip standard.

Figure 11B:
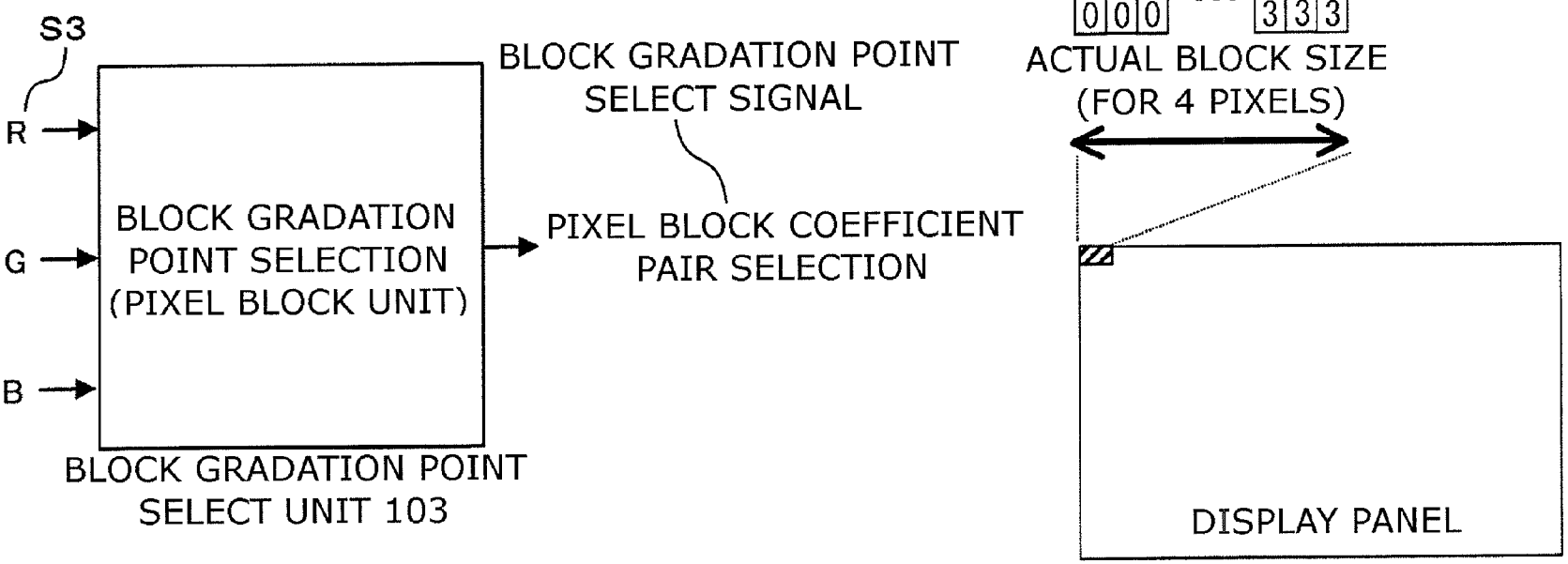

Therefore in this example, this processing is executed not in color block units, but in pixel block units. In other words, a sub-area is defined as an area composed of a plurality of pixels. FIG. 11B shows an example of coefficient pair selection in the case of processing in pixel block units. The block gradation point selection unit 103 of this example executes independent processing for each color, just like Example 1, but outputs the block gradation point select signal to the address generation unit 106 without distinguishing color. In other words, according to this example, blocks are not controlled by color unit, unlike the processing in color block units shown in FIG. 11A, but blocks are controlled in pixel units without distinguishing color, as shown in FIG. 11B.

Now a method for storing correction data in the volatile memories 102*a* and 102*b* for processing in pixel block units in FIG. 11B, and an access method thereof, will be described with reference to FIG. 13A and FIG. 13B.

Figure 13A:
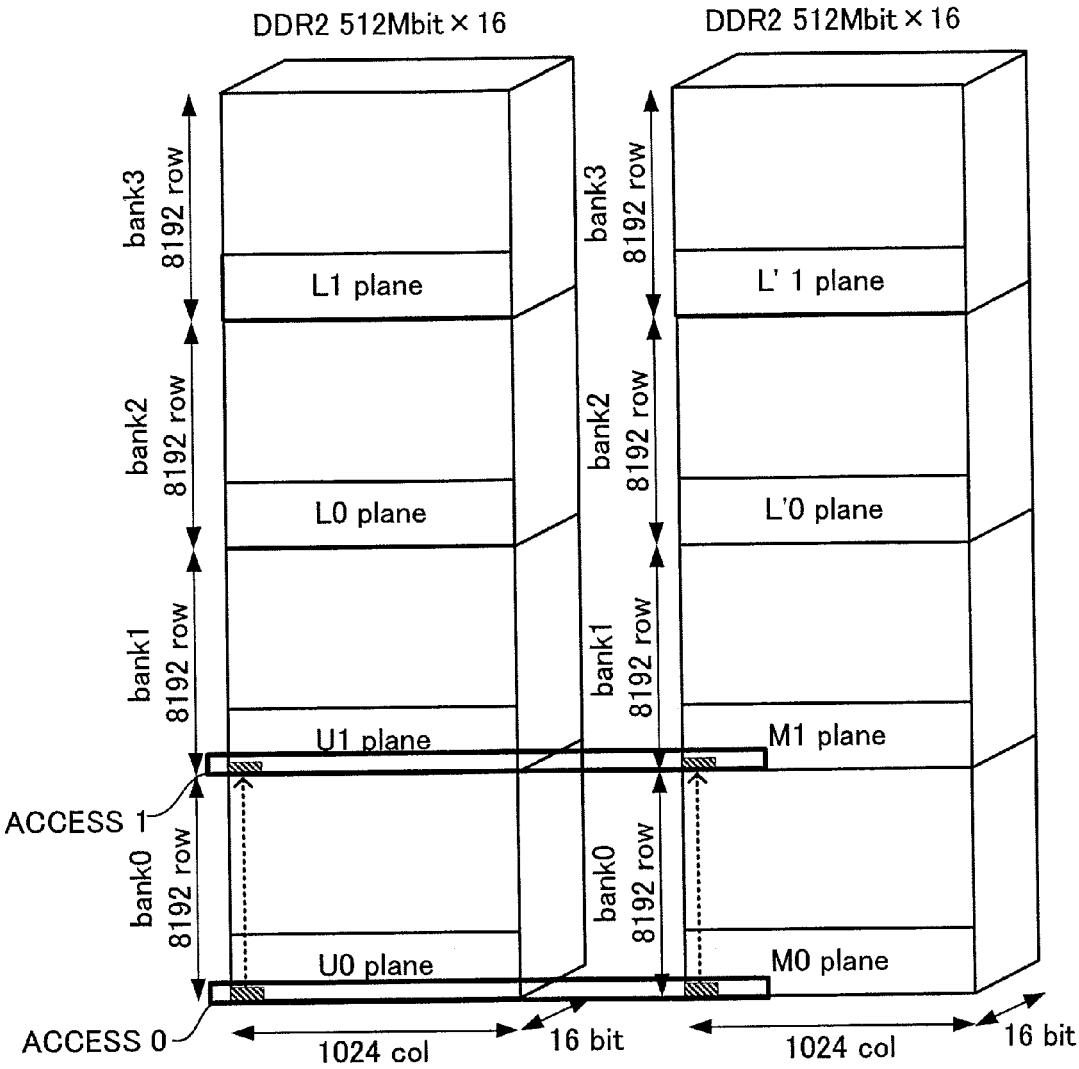
FIG. 13A shows an example of a method for storing correction data in a pixel block unit and an access method for reading the correction data.
Figure 13B:
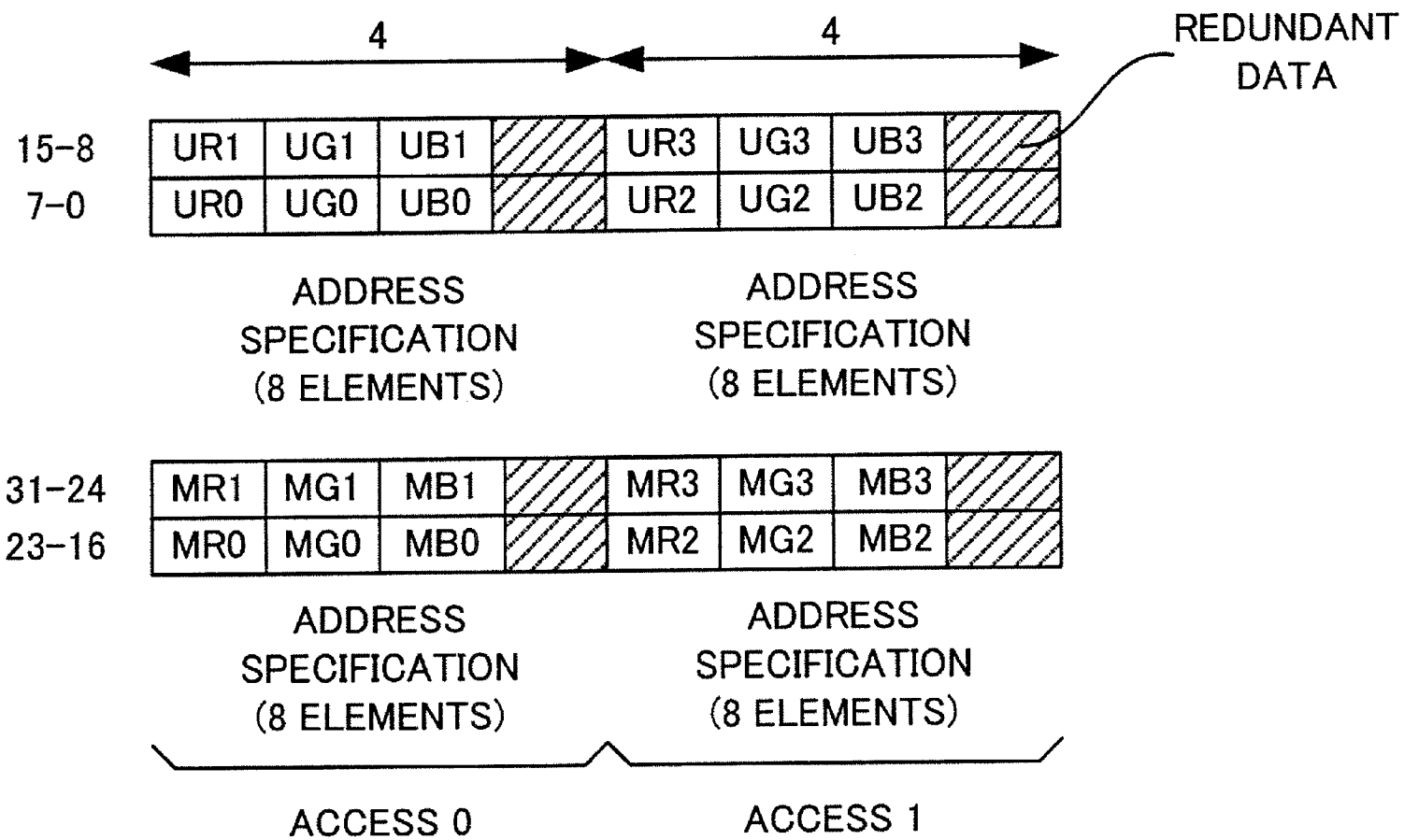
FIG. 13B shows an example of an access method for reading correction data in a pixel block unit.

FIG. 13A and FIG. 13B are examples when two DDR2-SDRAMs (512 Mbits×16) are used as the volatile memories 102*a* and 102*b*, just like FIG. 12A and FIG. 12B. FIG. 13A shows a physical address plane when four correction values corresponding to four gradation values are provided. DDR2-SDRAM has a bank configuration, and each gradation value is allocated to a different bank. A plurality of correction values corresponding to a same gradation value (a plurality of correction values supporting different elements) are divided and stored into a plurality of banks. For example, the correction values of point U, for elements adjacent to each other, are divided and stored into the U0 plane (bank 0) and U1 plane (bank 1) respectively. Four correction values corresponding to the four gradation values are divided by the method described in Example 1 (divided into point U and point L, and point M and point L').

In order to utilize the band of the memory most efficiently in this allocation to the physical addresses, the access method becomes as shown in FIG. 13B. In concrete terms, if one correction value has 8 bits/color, a partial access (access 0->access 1) of the four pixel block is regarded as a basic access unit, and a coefficient pair is read in 4 pixel block units. In this case, the correction data to be read is packed in pixel units, so redundant data must be inserted to match this correction data with the transfer size.

Now the reason why a plurality of correction values corresponding to a same gradation value are allocated into different banks will be described. In order to prevent a drop in efficiency due to overhead among accesses to DDR2-SDRAMs, a different bank must be accessed upon switching the addresses in any case. For example, if a coefficient pair of point U and point M is continuously selected in adjacent blocks in the case of not dividing a bank, a same bank is continuously selected. So as FIG. 13A shows, a plurality of correction values corresponding to a same gradation value are allocated to different banks. Since a bank to be selected is always switched among adjacent blocks (same bank is not continuously accessed by control unit), efficiency does not drop due to overhead. In the case of the example in FIG. 13A, a plurality of correction values corresponding to a same gradation value are divided and stored into two banks, but the number of banks is not limited to two. The plurality of correction values may be divided and stored into three or four banks. Critical here is that correction values are divided and stored into a plurality of banks so that a same bank is not continuously selected.

In the method in FIG. 13B, the memory band (memory clock frequency) is calculated as follows, just like the case of FIG. 12B.

$$\text{memory clock frequency}=297\ \text{MHz}\times(8\ \text{bits/color}\times(\text{RGB}+\text{redundant})\times 2)\times 1.0/32\ \text{bits}=594\ \text{MHz}$$

This can be supported if the chip standard is changed from DDR2-533 to DDR2-667. As mentioned above, band becomes 891 MHz in the case of color block units if the block size is four pixels, so this example is an effective method to decrease the block size.

Figure 14:
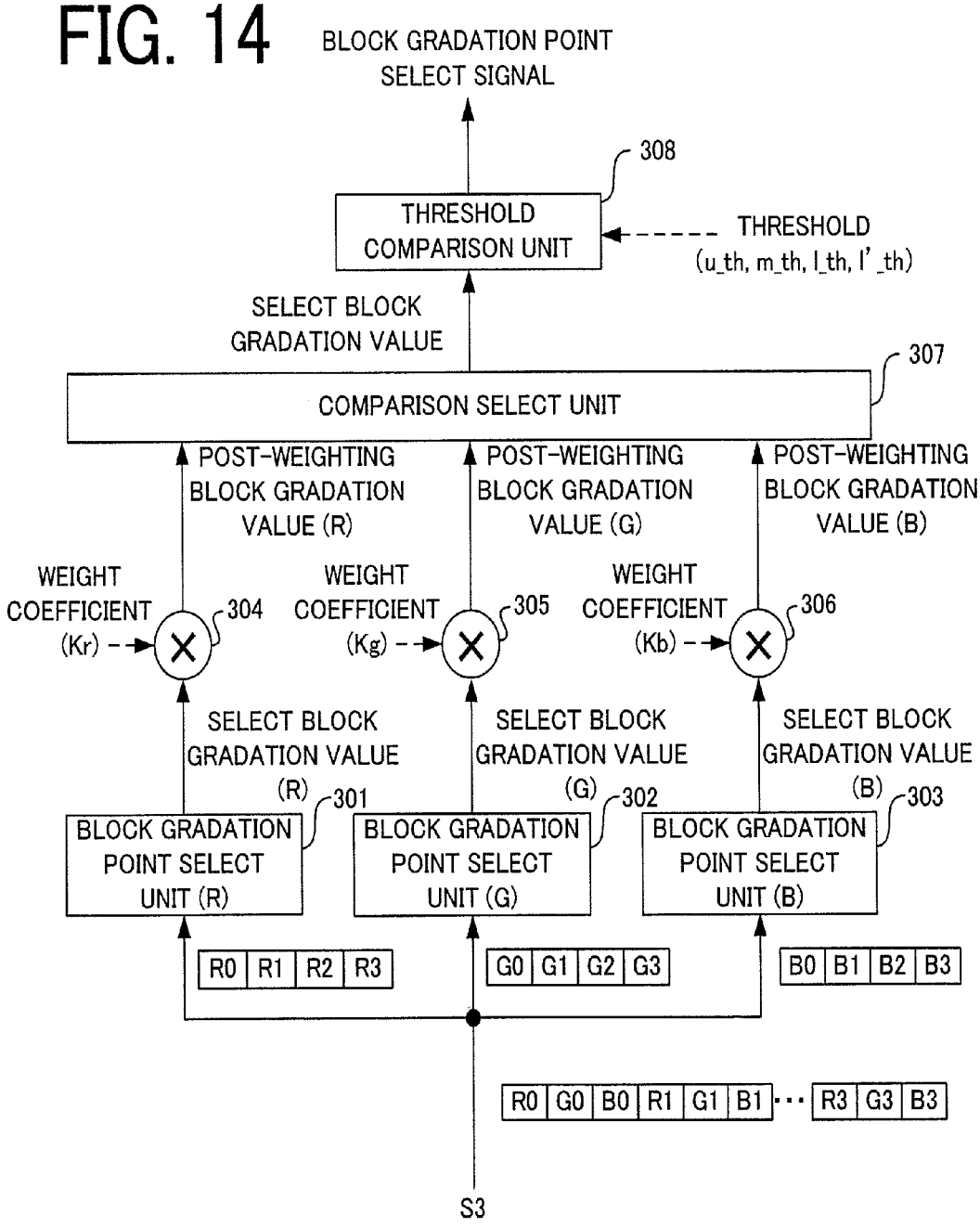
FIG. 14 is a block diagram depicting an example of a configuration of a block gradation point select unit of Example 2.

Finally details of the operation of the block gradation point select unit 103 shown in FIG. 11B will be described with reference to FIG. 14. The brightness data (signal S3: R, G, Bin FIG. 14) is input to the block gradation point select unit for R 301, block gradation point select unit for G 302, and block gradation point select unit for B 303, depending on the color. The processing content of these blocks are exactly the same as the processing from block buffer 2001 to selector 2006 in FIG. 9, and the select block gradation value is calculated for each color, in color block units of four elements.

Then multiplication units 304 to 306 multiply the select block gradation value of each color (R, G or B) by a weight coefficient Kr (for R), Kg (for G) and Kb (for B) which are different depending on the color (weighting processing). In concrete terms, the weighting processing according to the emission efficiency of each color is performed for the calculated select block gradation value, since human brightness variation detection performance depends on the emission brightness level of the display element (since a display element which emits brightly is more easily detected than a display element which emits darkly). Hereafter the weighted select block gradation value is called a "post-weighting block gradation value". In this example, the weight coefficients are set to be Green>Red>Blue based on the emission efficiency of phosphor, such as Kr=0.5, Kg=1.0 and Kb=0.25. These set values of the weight coefficients are merely examples, and the present invention is not limited to these values. For example, the values of the weight coefficients may be set not only by the emission efficiency of the phosphor, but also to include the efficiency of the color filter. The values of the weight coefficient may also be set to include the emission brightness of each color from the panel including all of those mentioned above, and all the elements of human visual characteristics. The values of the weight coefficients may also be adaptively changed considering the lighting state around the block, and all processing to provide different weighting for each color is included in this invention.

Then the comparison select unit 307 selects the maximum value of the post-weighting block gradation values of each color as a select block gradation value for determining a correction value to be read (select block gradation value used for controlling the correction unit), and transfer it to the threshold comparison unit 308. The threshold comparison unit 308 generates a block gradation point select signal by comparing the select block gradation value (maximum value) with the gradation value (threshold), as described in Example 1. Since this is a signal based on the gradation value which was selected using a post-weighting block gradation value of the brightest color in the four-pixel unit block, this signal is not for selecting an optimum correction value for an element which emits at other gradation values. However the difference is hardly detected in appearance for the above mentioned reason.

As described above, by processing in pixel block units, the block size can be decreased with less band compared with color block units. By weighting the select block gradation values for each color and determining the representative gradation value of the block, correction performance can be maintained.

EXAMPLE 3

In Example 1 and 2, a method for selecting the representative gradation value of the block only from the data pattern in the block was described. The present inventor confirmed that this method can be applied appropriately for almost all video patterns. However after earnest study, the present inventor discovered that for the specific patterns shown in FIG. 15A and FIG. 15B, it is better to select a representative gradation value considering the data patterns not only within the block, but also adjacent blocks. In Example 3, a processing method for selecting a representative gradation value also considering the information of adjacent blocks to select an optimum representative gradation value of the block for the specific patterns will be described.

Figure 15A:
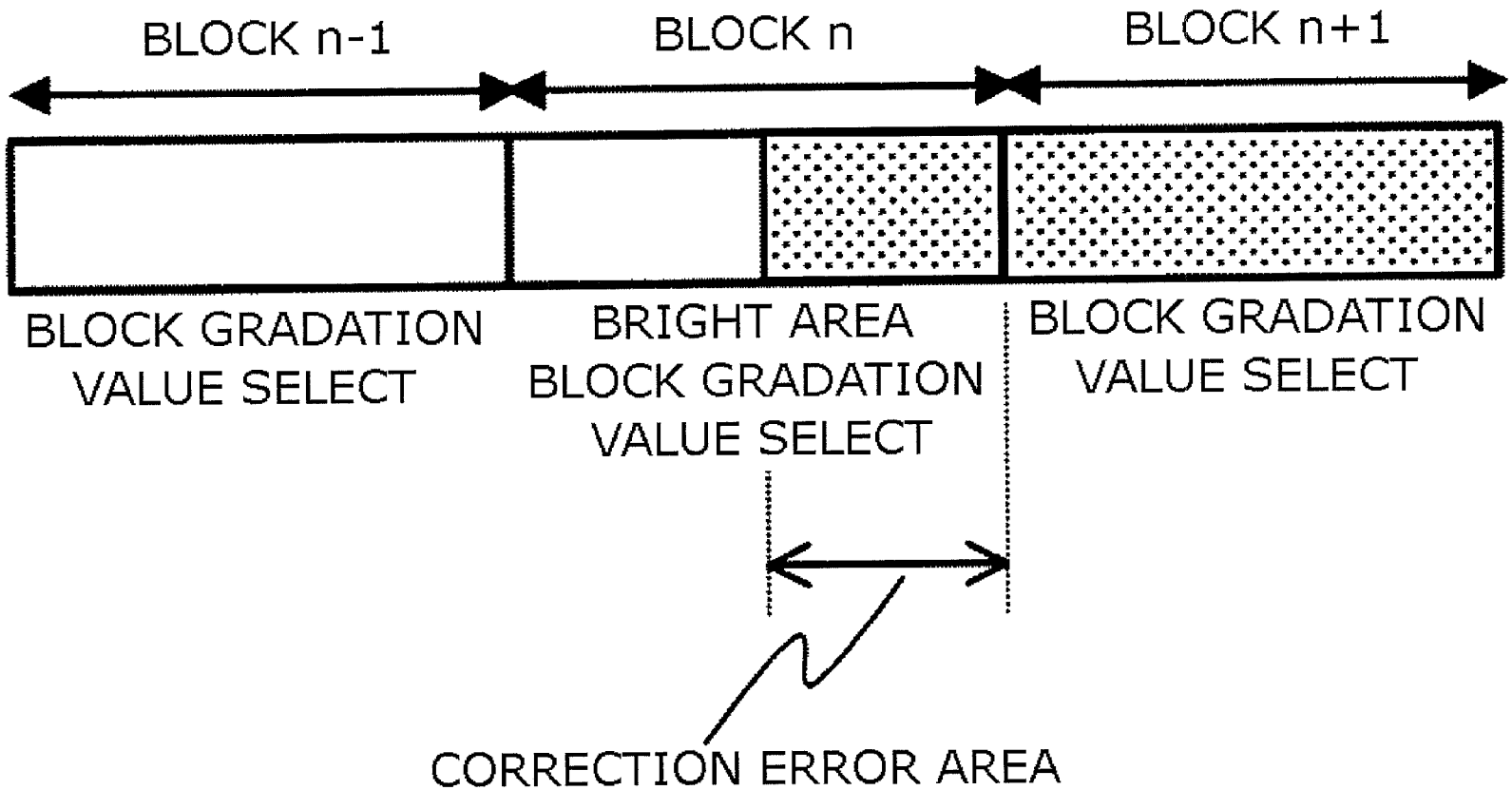
FIG. 15A and FIG. 15B show examples of a specific pattern where the influence of adjacent blocks should be considered.

FIG. 15A shows an example when a block of a bright image adjoins at the left of block n (block of which left half is a bright area and right half is a dark area), which is an edge pattern image, and a block of a dark image adjoins at the right thereof. In this case, it is preferable to select the bright area block gradation value with priority for block n. In concrete terms, if the bright block gradation value is selected, the correction error in the dark area at the right half in block n becomes greater than the bright area at the left half (dark area becomes a correction error area of which correction error is great). However, this correction error is hardly detected, because of the influence of the bright area which continues from block n−1 to the left half of block n.

Figure 15B:
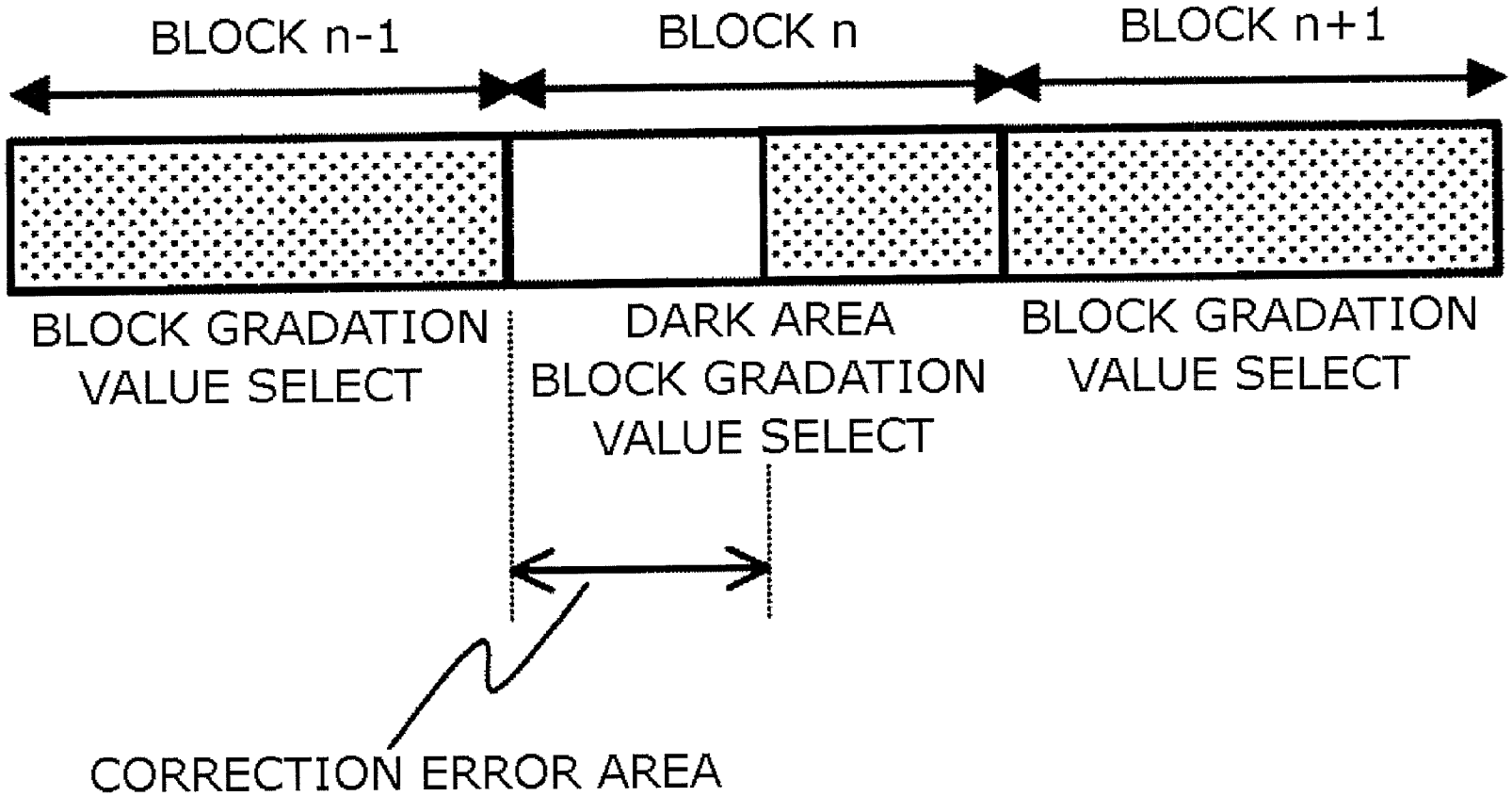

FIG. 15B, on the other hand, shows an example when a block of a dark image adjoins at the left of block n (block of which left half is a bright area and right half is a dark area) which is an edge pattern image, and a block of a bright image adjoins at the right thereof. In this case, if the bright area block gradation value is selected for block n, the correction error of the dark area at the right half of block n is more easily detected than the case of FIG. 15A. This is because block n−1 in FIG. 15B is a block of a dark image, and compared with the case of FIG. 15A, the ratio of the bright area decreased, and the ratio of the dark area continuing from the right half of block n to block n+1 increased. Also as the gradation value of the bright area and the gradation value of the dark area in block n become closer, as the ratio of the bright area (ratio in block) decreases, and as the block size increases, the correction error is detected more easily.

To solve these problems, in this example, the images in sub-areas around the processing target sub-area are referred to. If the image in the processing target sub-area is an edge pattern image, and the images in adjacent sub-areas at least on both sides, are images of a dark area, then the average gradation value of the dark area constituting the edge of the processing target sub-area is calculated as the select block gradation value. In other words, the bright area is selected as the correction error area (FIG. 15B).

Figure 16:
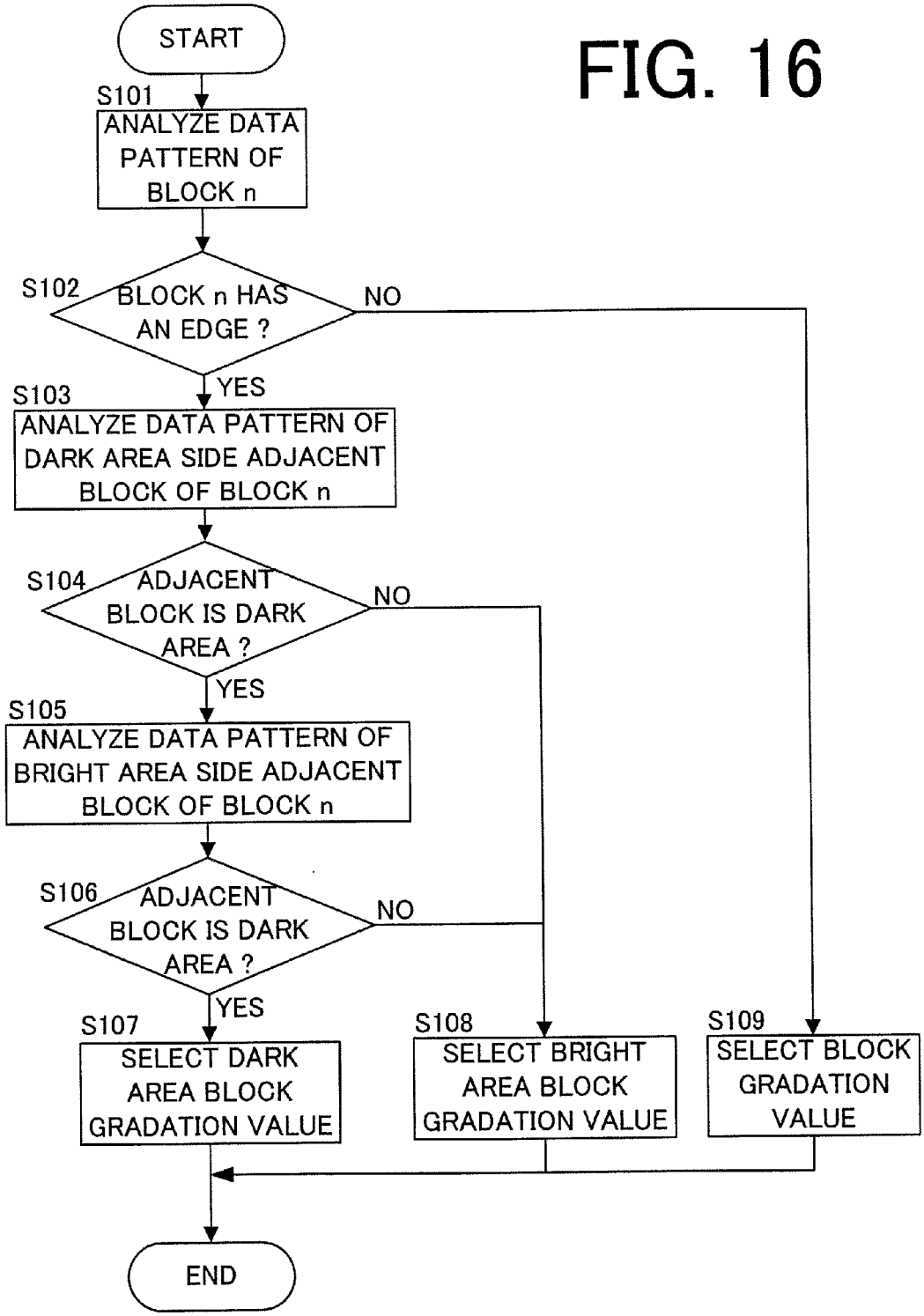
FIG. 16 is a flow chart depicting an example of the processing of a block pattern analysis unit of Example 3.

In concrete terms, a buffer large enough to temporarily store three blocks of (12 pixels of) brightness data, including the target block and adjacent blocks, is used for block buffer 2001. Then the processing of the block pattern analysis unit 2002 is performed according to the flow chart in FIG. 16. The processing of the block pattern analysis unit 2002 of this example will now be described.

In S101, data pattern analysis, such as edge detection, is performed for block n, as described in Examples 1 and 2.

If an edge is not detected (S102: NO), processing advances to S109, where a block gradation value is selected as the select block gradation value.

If an edge is detected (S102: YES), the data pattern analysis of the adjacent block at the dark area side (block n−1 in the case of FIG. 15A and FIG. 15B) of block n in S103 is performed in the same manner as S101. If it is determined that the image of the adjacent block is an image of a dark area which does not include an edge (S104: YES), processing advances to S105. Otherwise (S104: NO) processing advances to S108, where the bright area block gradation value is selected as the select block gradation value.

In S105, the data pattern analysis of an adjacent block at the bright area side (block n+1 in the case of FIG. 15A and FIG. 15B) of block n is performed in the same manner as S103. If it is determined that the image of the adjacent block is an image of a dark area which does not include an edge (S106: YES), processing advances to S107, where the dark area block gradation value is selected as the select block gradation value. Otherwise (S106: NO) processing advances to S108, where the bright block gradation value is selected as the select block gradation value.

As described above, by determining a correction value to be read considering information of adjacent blocks as well, a number of data patterns that can be supported can be increased, and therefore correction performance can be improved even more than Examples 1 and 2.

The above description is an example to clearly describe the example considering the data patterns of adjacent blocks, and the processing method is not limited to this example. For example, instead of referring to the adjacent two blocks as described above, peripheral blocks thereof may also be referred to.

As described above, according to the image display apparatus according to the present embodiment and the control method thereof, a gradation value of a correction value, which is read for each block, is determined. Thereby a decrease in processing band of a storage unit, which is required for reading correction data used for processing to decrease gradation-dependent brightness variation from the storage unit, can be implemented without dropping brightness variation correction performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-033914, filed on Feb. 18, 2010, which is hereby incorporated by reference herein in its entirety.

What is claimed is:

1. An image display apparatus comprising:

a display panel having a plurality of display elements disposed in a matrix form;

a storage unit that stores correction data for each display element used in correction processing for decreasing brightness variation among the plurality of display elements, including N, with N being an integer of 3 or more, number of correction values corresponding to N number of gradation values for each display element;

a correction unit that reads the correction data from the storage unit and executes the correction processing; and a control unit, wherein the control unit divides the display panel into a plurality of sub-areas, calculates, for each sub-area, a select block gradation value which is a gradation value representing the sub-area, and executes, for each sub-area, control to read n, with n being an integer of 1 or more and less than N, number of correction values, which are used for calculating a correction value corresponding to the select block gradation value, out of the N number of correction values of each display element in the sub-area, using the correction unit, and the correction unit calculates, for each sub-area, a correction value corresponding to the select block gradation value using the n number of read correction values, and converts gradation values of video signals for display elements in the sub-area using the calculated correction value.

2. The image display apparatus according to claim 1, wherein the control unit calculates, for each sub-area, an average gradation value of the video signals for the display elements in the sub-area as the select block gradation value, if a correlation of an image in the sub-area is higher than a predetermined standard, and calculates, for each sub-area, a select block gradation value using a gradation value higher than a predetermined gradation value, out of the gradation values of the video signals for the display elements in the sub-area, if the correlation of the image in the sub-area is lower than the predetermined standard.

3. The image display apparatus according to claim 1, wherein the control unit calculates, for each sub-area, an average gradation value of the video signals for the display elements in the sub-area as the select block gradation value.

4. The image display apparatus according to claim 1, wherein the control unit determines, for each sub-area, whether an image in the sub-area is an edge pattern image which includes an edge, and calculates, for a sub-area of an edge pattern image, an average gradation value of a high gradation side area constituting the edge as the select block gradation value.

5. The image display apparatus according to claim 4, wherein if an edge exists in the image in the sub-area and a difference of gradation values between a low gradation side area and the high gradation side area constituting the edge is a predetermined value or more, the control unit determines this image as an edge pattern image.

6. The image display apparatus according to claim 4, wherein if an edge exists in the image in the sub-area and a ratio of the high gradation side area to a low gradation side area constituting the edge is within a predetermined range, the control unit determines this image as an edge pattern image.

7. The image display apparatus according to claim 4, wherein if an edge exists in the image in the sub-area and a number of existing edges is one, the control unit determines this image as an edge pattern image.

8. The image display apparatus according to claim 4, wherein the control unit refers to images in sub-areas around a processing target sub-area, and if an image in the processing target sub-area is an edge pattern image and at least images in adjacent sub-areas on both sides of the processing target sub-area are images in a low gradation side area, the control unit calculates an average gradation value of the low gradation side area constituting the edge of the processing target sub-area as the select block gradation value.

9. The image display apparatus according to claim 1, wherein the plurality of display elements in the display panel are three display elements corresponding to three colors, R, G and B respectively, which are disposed as one pixel, and the sub-area is an area composed of a plurality of display elements corresponding to an identical color.

10. The image display apparatus according to claim 1, wherein the plurality of display elements in the display panel are three display elements corresponding to three colors, R, G and B respectively, which are disposed as one pixel, the sub-area is an area composed of a plurality of pixels, and the control unit calculates a select block gradation value for each color, performs different weighting processing, depending on each color, for the calculated select block gradation value, and selects a maximum value of the weighted values as the select block gradation value to be used for controlling the correction unit.

11. The image display apparatus according to claim 1, wherein the storage unit is a memory having a bank configuration, and the correction data is divided and stored into a plurality of banks so that a same bank is not continuously accessed by the control unit.

12. The image display apparatus according to claim 9, wherein the storage unit is a memory having a bank configuration, and the correction data is stored in a different bank at least depending on each color so that a same bank is not continuously accessed by the control unit.

13. The image display apparatus according to claim 10, wherein the storage unit is a memory having a bank configuration, and a plurality of correction values corresponding to a same gradation value, out of the correction data, are divided and stored into a plurality of banks so that a same bank is not continuously accessed by the control unit.

14. The image display apparatus according to claim 1, wherein the display element is an electron-emitting device.

15. A method for controlling an image display apparatus which includes a display panel having a plurality of display elements disposed in a matrix form, a storage unit that stores correction data for each display element used in correction processing for decreasing brightness variation among the plurality of display elements, including N, with N being an integer of 3 or more, number of correction values corresponding to N number of gradation values for each display element, a correction unit that reads the correction data from the storage unit and executes the correction processing, and a control unit, the method comprising the steps of:

the control unit dividing the display panel into a plurality of sub-areas and calculating, for each sub-area, a select block gradation value which is a gradation value representing the sub-area;

the correction unit reading n, with n being an integer of 1 or more and less than N, number of correction values, which are used for calculating a correction value corresponding to the select block gradation value, out of the N number of correction values of each display element in the sub-area; and the correction unit calculating, for each sub-area, a correction value corresponding to the select block gradation value using the n number of read correction values, and converting gradation values of video signals for display elements in the sub-area using the calculated correction value.

* * * * *